US011198302B2

(12) United States Patent
Wada et al.

(10) Patent No.: US 11,198,302 B2
(45) Date of Patent: Dec. 14, 2021

(54) INK JET PRINTING APPARATUS AND METHOD OF CONTROLLING THE SAME

(71) Applicant: CANON KABUSHIKI KAISHA, Tokyo (JP)

(72) Inventors: Naoaki Wada, Yokohama (JP); Noriyuki Aoki, Tokyo (JP); Tomohito Abe, Yokohama (JP); Daigo Kuronuma, Kawasaki (JP); Ryutaro Takahashi, Tokyo (JP); Masakazu Nagashima, Yokohama (JP); Ryohei Maruyama, Kawasaki (JP); Toshiaki Yamaguchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 16/838,584

(22) Filed: Apr. 2, 2020

(65) Prior Publication Data

US 2020/0338899 A1 Oct. 29, 2020

(30) Foreign Application Priority Data

Apr. 24, 2019 (JP) ..... JP2019-082863

(51) Int. Cl.
*B41J 29/38* (2006.01)
*B41J 2/175* (2006.01)

(52) U.S. Cl.
CPC ..... *B41J 2/17546* (2013.01)

(58) Field of Classification Search
CPC ..... B41J 2/175; B41J 2/1752; B41J 2/17546
USPC ..... 399/1, 5, 6, 19
See application file for complete search history.

(56) References Cited

U.S. PATENT DOCUMENTS

| | | | | |
|---|---|---|---|---|
| 4,775,871 | A | 10/1988 | Abe et al. | 347/85 |
| 6,267,474 | B1 * | 7/2001 | Mochizuki | B41J 2/175 347/85 |
| 6,948,803 | B2 * | 9/2005 | Yoshida | B41J 2/175 347/85 |
| 8,602,513 | B2 | 12/2013 | Ara et al. | 347/7 |
| 9,102,162 | B2 | 8/2015 | Watanabe et al. | B41J 2/16532 |
| 9,855,758 | B2 | 1/2018 | Obata et al. | B41J 2/1652 |
| 9,902,160 | B2 | 2/2018 | Sugiyama et al. | B41J 2/17523 |
| 2019/0232671 | A1 | 8/2019 | Danzuka et al. | B41J 2/16532 |

FOREIGN PATENT DOCUMENTS

| | | |
|---|---|---|
| JP | 2016-112882 | 6/2016 |

* cited by examiner

*Primary Examiner* — Hoan H Tran
(74) *Attorney, Agent, or Firm* — Venable LLP

(57) ABSTRACT

An object of the present invention is to provide an ink jet printing apparatus that can reduce the time for the initial installment. In the present invention, in the initial installation, once an ink tank is attached to a printing apparatus main body, a notification unit makes a notification prompting attaching of a printing head during an operation of supplying ink from the ink tank to a reservoir tank.

15 Claims, 17 Drawing Sheets

INK JET PRINTING APPARATUS AND METHOD OF CONTROLLING THE SAME

BACKGROUND OF THE INVENTION

Field of the Invention

The present invention relates to an ink jet printing apparatus including a reservoir tank and a method of controlling an ink jet printing apparatus.

Description of the Related Art

There has been known an ink jet printing apparatus including a reservoir tank between an ink tank and a printing head. Such an ink jet printing apparatus can continue the printing operation even if the ink tank becomes empty by using ink in the reservoir tank. It is also possible to replace the ink tank while the printing operation is being continued by using the ink in the reservoir tank.

Japanese Patent Laid-Open No. 2016-112882 discloses an ink jet printing apparatus (hereinafter, also referred to as simply a printing apparatus) including an ink tank and a reservoir tank. In this printing apparatus, ink from the ink tank is supplied to the reservoir tank and thereafter supplied to the printing head through a supply tube.

In general, the initial installation of an ink jet printing apparatus requires an initial filling processing to fill a printing apparatus main body and a printing head with ink. As the initial filling processing, the printing apparatus disclosed in Japanese Patent Laid-Open No. 2016-112882 fills the reservoir tank with the ink from the ink tank and then performs a processing of filling the printing head with the ink from the reservoir tank. Additionally, the printing apparatus disclosed in Japanese Patent Laid-Open No. 2016-112882 detects attaching of both the ink tank and printing head and then starts the filling of the reservoir tank with the ink. There has been accordingly a problem that the initial installation of the printing apparatus requires a long time.

SUMMARY OF THE INVENTION

The present invention is an ink jet printing apparatus, including: an ink tank that is detachably provided to a printing apparatus main body; a reservoir tank that stores ink supplied from the ink tank; a printing head that is detachably provided to the printing apparatus main body and ejects the ink supplied from the reservoir tank; a first supply unit that supplies the ink from the ink tank to the reservoir tank; and a control unit that causes a notification unit to make a notification of a preparation work for a printing operation performed by the printing head while the ink is being supplied by the first supply unit from the ink tank to the reservoir tank.

According to the present invention, it is possible to provide an ink jet printing apparatus capable of reducing the time for initial installation.

Further features of the present invention will become apparent from the following description of exemplary embodiments with reference to the attached drawings.

BRIEF DESCRIPTION OF THE DRAWINGS

FIG. 6 shows a relationship between FIGS. 6A and 6B;

FIG. 8 shows a relationship between FIGS. 8A and 8B;

FIG. 11 shows a relationship between FIGS. 11A and 11B;

DESCRIPTION OF THE EMBODIMENTS

First Embodiment

Hereinafter, a first embodiment of the present invention is described with reference to FIGS. 1 to 6A and 6B. In this embodiment, a serial-type ink jet printing apparatus is used as an example for describing an ink jet printing apparatus.

1. Ink Jet Printing Apparatus

Figure 1:
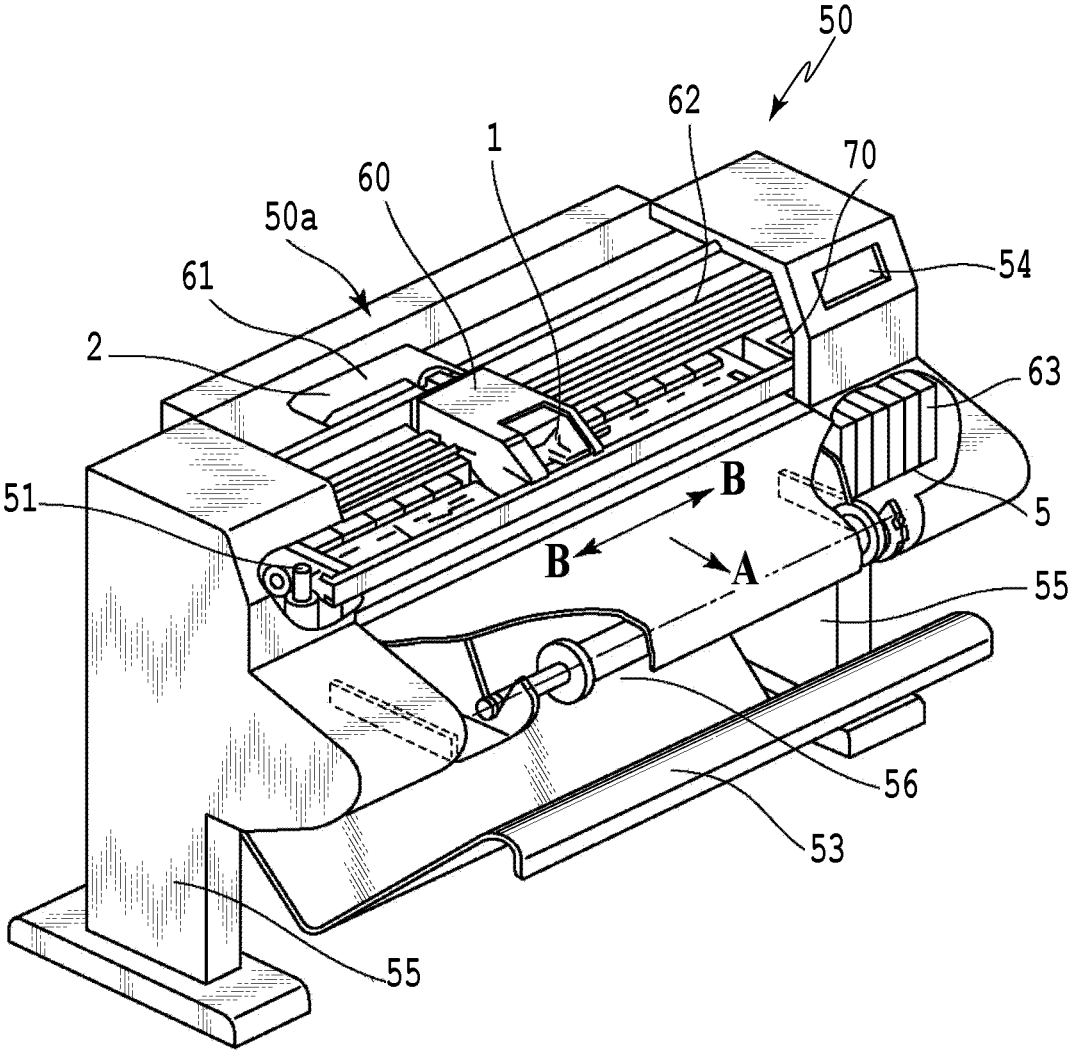
FIG. 1 is a perspective conceptual diagram of an ink jet printing apparatus of a first embodiment.

FIG. 1 is a perspective conceptual diagram of the ink jet printing apparatus of this embodiment. As illustrated in FIG. 1, an ink jet printing apparatus 50 (hereinafter, referred to as simply a "printing apparatus") includes a printing apparatus main body 50*a* and two leg portions 55 holding the printing apparatus main body 50*a*. The printing apparatus main body 50*a* is provided with a carriage 60 that can reciprocate along a main scanning direction (B direction). The carriage 60 is equipped with a detachable printing head 1 that can eject ink.

Additionally, the printing apparatus main body 50*a* is provided with a roll holder unit 56 (printing medium holding unit). This roll holder unit 56 detachably holds a roll sheet, which is a roll of a continuous sheet as a printing medium.

In the case where the printing apparatus 50 performs the printing operation, the roll sheet (hereinafter, sheet) set in the roll holder unit 56 is fed to a printing position. Once the sheet is fed to the printing position, the carriage 60 equipped with the printing head 1 reciprocates in the main scanning direction (B direction) by a carriage motor (not illustrated) and a belt transmission unit 62. During the movement in the main scanning direction, the printing head 1 ejects ink drops based on image data. Once the carriage 60 reaches one end in the B direction of the sheet, a conveyance roller (not illustrated) conveys the sheet in a sub scanning direction (A direction) for a predetermined amount. In this embodiment, the main scanning direction and the sub scanning direction are orthogonal to each other.

As described above, an image is formed on the entirety of the sheet by repeating alternately the printing operation by the printing head 1 and the conveyance operation by the conveyance roller. After the image formation, the sheet is cut by a not-illustrated cutter, and the thus-cut printing media are stacked on a stacker 53.

The ink supply unit 63 is provided with an ink tank that is attachable to and detachable from the printing apparatus 50. In this embodiment, ink tanks 5 of ink colors such as black, cyan, magenta, and yellow are provided. Each of the multiple ink tanks 5 is connected with a supply tube 2 (ink flow channel) through the later-described reservoir tank 4. The supply tubes 2 are bound up by a tube guide 61 to prevent the supply tubes 2 from being disordered during the reciprocating operation of the carriage 60.

On a surface (ejection port surface) of the printing head 1 opposed to the sheet, multiple ejection ports for discharging the ink are aligned along the sub scanning direction (A direction), and those ejection ports constitute a ejection port array. The ejection port array is provided for each ink color, and the ejection port array is connected to the supply tube 2 of the corresponding ink color.

A recovery unit 70 that can face the ejection port surface of the printing head 1 is provided in an area, which is outside the printing region in which the printing head 1 equipped in the carriage 60 performs the printing operation but is inside the scanning region of the carriage 60. The recovery unit 70 is positioned on the outer side in the main scanning direction of a region in which the sheet being conveyed in the A direction passes through. The recovery unit 70 includes a suction unit that cleans the ejection port by sucking out the ink or the air from the ejection port surface of the printing head 1 as needed, and sucks out forcibly the air accumulated in the printing head. The suction unit includes a cap 35 movable to a covering position to cover the ejection port surface of the printing head 1 and to a spacing position to make a space from the ejection port, and a pump for generating a negative pressure in the cap 35. Additionally, this suction unit also functions as a second supply unit that supplies the ink from the reservoir tank to the printing head 1.

The printing apparatus main body 50*a* is provided with an operation panel 54, and a user can input various commands to the printing apparatus 50 through this operation panel 54. Additionally, in the case where an ink tank 5 of the ink becomes empty, it is also possible to prompt the replacement of the ink tank 5 by displaying a caution message to the user.

Figure 2:
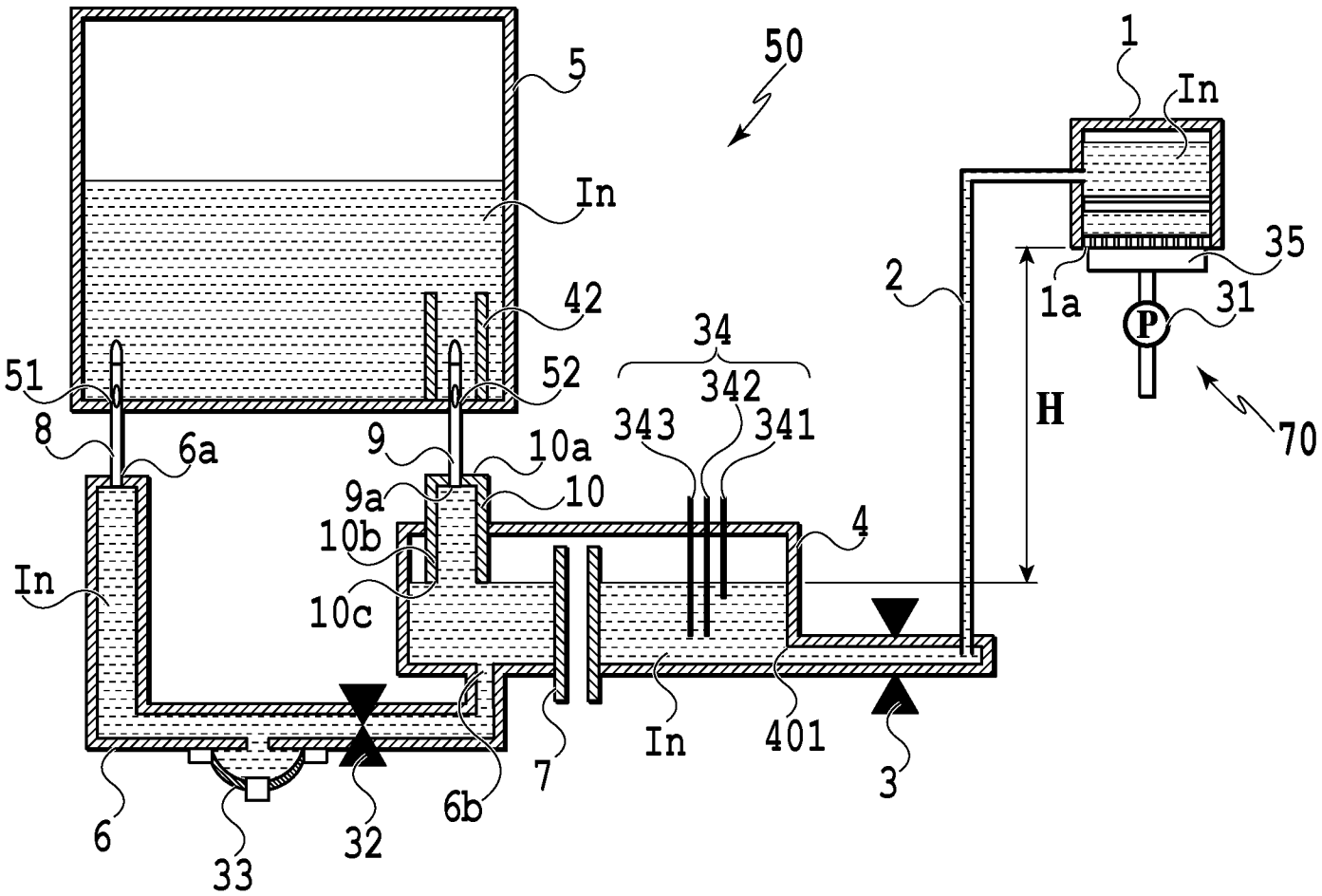
FIG. 2 is a conceptual diagram of an ink flow channel of the ink jet printing apparatus of the first embodiment.

FIG. 2 is a conceptual diagram of the ink flow channel of the ink jet printing apparatus of this embodiment. Although there are provided the multiple ink flow channels for the respective ink colors in this embodiment, an ink flow channel of one color is described herein since all the ink flow channels have the same configuration. As illustrated in FIG. 2, the printing apparatus 50 of this embodiment includes the ink tank 5 storing the ink, the reservoir tank 4 storing the ink supplied from the ink tank 5, and the printing head 1 that performs printing by using the ink supplied from the reservoir tank 4.

The reservoir tank 4 is arranged below the ink tank 5 in the direction of gravity. An ink supply channel 6 supplying the ink from the ink tank 5 to the reservoir tank 4 and an air introduction channel 10 introducing the air from the reservoir tank 4 to the ink tank 5 are provided between the ink tank 5 and the reservoir tank 4. The reservoir tank 4 includes an air communication unit 7 communicated with the atmospheric air and is open to the atmosphere.

The ink tank 5 does not include an air communication unit and is not open to the atmosphere. The ink tank 5 is attachable to and detachable from the reservoir tank 4 held by the printing apparatus main body 50*a*. The ink supply channel 6 is provided with a flexible portion 33 and a reservoir valve 32 (open-close unit) as a first supply unit for supplying the ink from the ink tank 5 to the reservoir tank 4. The flexible portion 33 is formed of a flexible member capable of varying the internal volume. This flexible portion 33 is deformed by a drive mechanism 16 (not illustrated in FIG. 2 (see FIG. 3)) to decrease or increase the internal volume, and thereby the ink flows into and out from the flexible portion 33. The reservoir valve 32 is arranged between the reservoir tank 4 and the flexible portion 33, and the communication and the interruption between the reservoir tank 4 and the flexible portion 33 are switched by switching between the open state and the closed state of this reservoir valve 32.

In this embodiment, the flexible portion 33 is provided in the lowest portion in the direction of gravity in the ink supply channel 6. This reduces the mixing of air bubbles into the flexible portion 33. In this embodiment, the amount of variation in the volume of the flexible portion 33 is set to about 0.7 to 1 milliliters. It is also possible to implement the embodiment with the arrangement or the internal volume of the flexible portion 33 being varied as appropriate.

The ink tank 5 has an internal space capable of reserving the ink, and two parts of a bottom section thereof are provided with joint portions 51 and 52. These joint portions 51 and 52 are formed of an elastic member that allows the later-described first hollow tube 8 and second hollow tube 9 to be inserted to and drawn from the joint portions 51 and 52, respectively. Additionally, an inner surface of the bottom section of the ink tank 5 is provided with a tubular rising-up wall 42 that can surround the periphery of the second hollow tube 9 inserted in the ink tank 5.

In the ink supply channel 6, one end 6*a* thereof can be connected to and drawn from the joint portion 51 of the ink tank 5 by way of the first hollow tube 8, and the other end 6*b* is connected to a bottom section of the reservoir tank 4. An air introduction channel 10 is fixed on a top section of the reservoir tank 4. One end 10*a* of the air introduction channel 10 can be connected to and drawn from the joint portion 52 of the ink tank 5 by way of the second hollow tube 9, and the other end 10*b* is inserted inward from a top surface portion of the reservoir tank 4. An opening 10*c* is formed in the other end of the air introduction channel 10.

In the reservoir tank 4, the position of an opening formed in the other end 6*b* of the ink supply channel 6 is arranged below the position of the opening 10*c* of the air introduction channel 10. This makes the water head difference, which allows the air to be introduced from the reservoir tank 4 to the ink tank 5 through the air introduction channel 10 and the second hollow tube 9 in the case where the ink is supplied from the ink tank 5 to the reservoir tank 4 through the first hollow tube 8 and the ink supply channel 6. On the other hand, in the case where the opening 10*c* is sealed because of the increase of the liquid level in the reservoir tank 4, the movement of the air from the reservoir tank 4 to the ink tank 5 is stopped, and the supplying of the ink from the ink tank 5 to the reservoir tank 4 is also stopped.

As described above, this embodiment employs a bird-feeding supply method, which allows the air to be introduced into the ink tank 5 through the air introduction channel 10 and simultaneously the ink to be automatically supplied to the reservoir tank 4 in the case where the ink in the reservoir tank 4 is consumed and the liquid level is decreased. The liquid level of the ink in the reservoir tank 4 is positioned at substantially the same height as the height of the opening 10*c* of the air introduction channel 10 until the ink in the ink tank 5 is all gone.

There are provided metal shafts 341 to 343 made of metal as an electrode 34 inside of the reservoir tank 4. A lower end of the first metal shaft 341 is provided slightly below the opening 10*c* of the air introduction channel 10 (in this embodiment, about 4 mm below). This makes it possible to reliably detect whether the reservoir tank 4 is filled up. The second metal shaft 342 and the third metal shaft 343 have substantially the same lengths, and lower ends thereof are positioned below the lower end of the first metal shaft 341 and positioned above an upper end of an ink flow-out port 401 of the reservoir tank 4.

In the case where the reservoir tank 4 is filled up with the ink, the ink is put in contact with the first metal shaft 341 and the third metal shaft 343, and thereby the electric resistance between the two metal shafts is low. In the case where a weak voltage is applied between the first metal shaft 341 and the third metal shaft 343 in this case, the two metal shafts have an electrical connection. Thus, it is possible to detect whether the reservoir tank 4 is in the "filled-up state" based on whether the first metal shaft 341 and the third metal shaft 343 have the electrical connection.

In the case where a weak voltage is applied between the second metal shaft 342 and the third metal shaft 343 with the ink liquid level in the reservoir tank 4 is lower than the lower end of the second metal shaft 342, no current flows between the two metal shafts. Thus, it is possible to detect whether the reservoir tank 4 is in the "empty state" based on whether the second metal shaft 342 and the third metal shaft 343 have the electrical connection.

As described above, the electrode 34 (the second metal shaft 342 and the third metal shaft 343) that detects the lower limit of the amount of the ink in the reservoir tank 4 (the "empty state") is positioned above the upper end of the ink flow-out port 401. In the case where the electrode 34 detects that the liquid level in the reservoir tank 4 is in the "empty state" (state of being lower than the lower limit value), all the operations consuming the ink (such as printing operation, cleaning operation, and so on) are prohibited by a control unit, which is described later, until the liquid level is increased to be higher than the lower limit value.

That is, under normal use, the liquid level of the ink in the reservoir tank 4 is equal to or higher than the height of the upper end of the ink flow-out port 401 even if the reservoir tank 4 is in the "empty state". Consequently, even if the reservoir tank 4 is in the "empty state", since the ink flow-out port 401 is sealed by the liquid surface of the ink in the reservoir tank 4, the air (air bubbles) does not easily flow to the printing head 1 from the ink flow-out port 401.

As long as the ink remains in the ink tank 5, the "filled-up state" of the reservoir tank 4 is maintained by the bird-feeding supply method. Consequently, in the case where the electrode 34 detects that the reservoir tank 4 of the ink is not in the "filled-up state", it is possible to assume that the current ink tank 5 of the ink is in the "empty state". In other words, the electrode 34 also can detect the "empty state" of the ink tank 5.

In this embodiment, the ink flow-out port 401 is provided in the lowest position in the direction of gravity on a side surface of the reservoir tank 4. Additionally, a supply valve 3 that switches between the communication and the interruption between the reservoir tank 4 and the supply tube 2 is provided between the reservoir tank 4 and the supply tube 2.

In this embodiment, the negative pressure of the ink in the printing head 1 is maintained because of the water head difference H (see FIG. 2) between the liquid level of the ink In in the reservoir tank 4 and a ejection port surface 1*a* of the printing head 1. In this embodiment, the water head difference H is set to about 80 mm.

In the case where the air is accumulated in the printing head 1, it is required to forcibly remove the air from the printing head 1. One way of removing the air from the printing head is to suck the printing head 1 by the recovery unit 70 (FIG. 1) with the supply valve 3 closed.

Specifically, the air is sucked out by attaching the cap 35 closely to the ejection port surface of the printing head 1 and driving a suction pump 31 constituting the recovery unit 70 with the supply valve 3 closed (FIG. 1). Once the supply valve 3 is opened after the suction for a predetermined period of time (in this embodiment, about 25 seconds), the printing head 1 is started to be filled with the ink. Specifically, opening of the supply valve 3 after the suction allows a predetermined amount of ink to be sucked from the reservoir tank 4 to the printing head 1 due to the negative pressure charged in the printing head 1, and the printing head 1 is thus filled with the ink.

Figure 3:
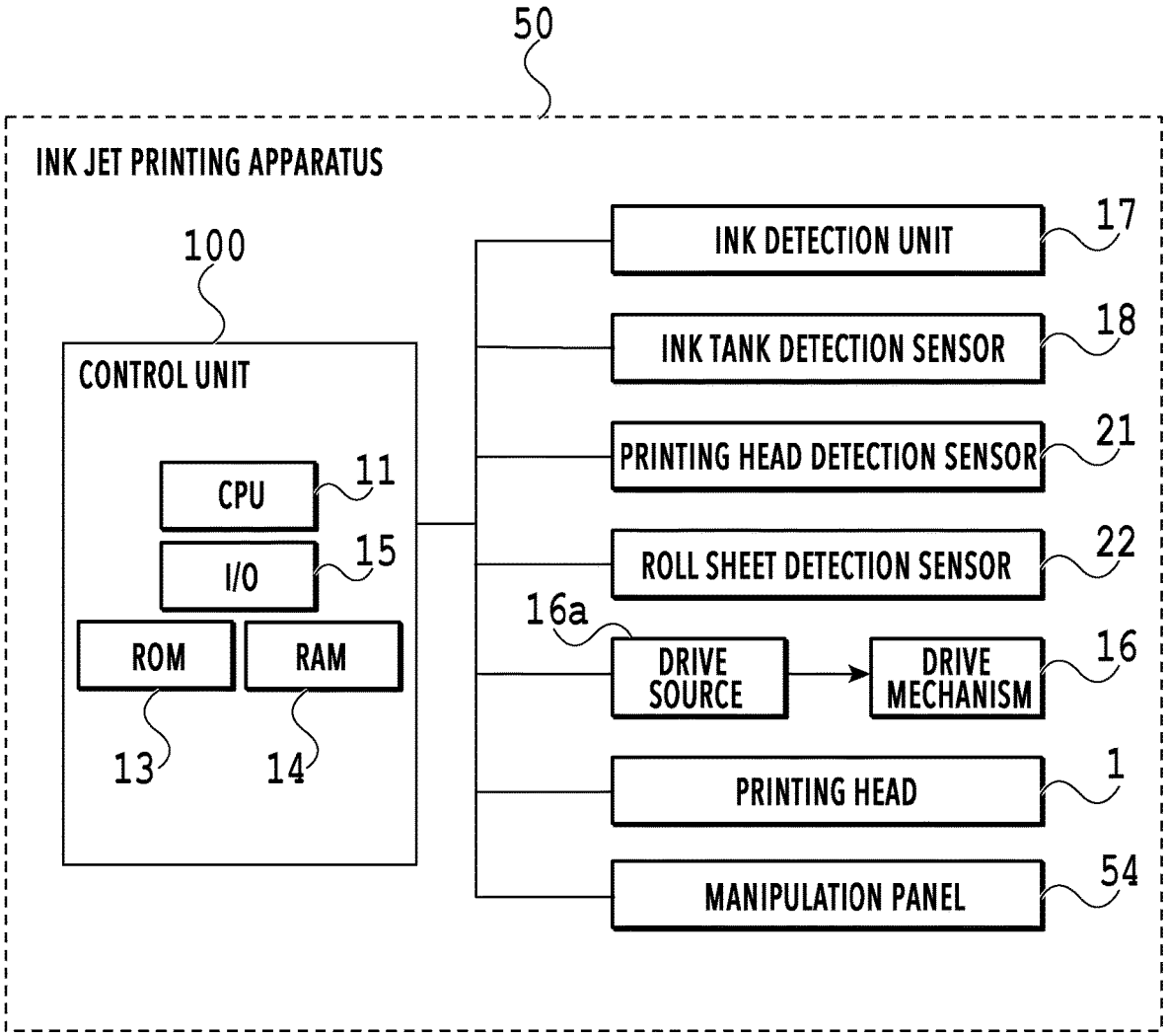
FIG. 3 is a block diagram illustrating a control system of the ink jet printing apparatus of the embodiment.

FIG. 3 is a block diagram illustrating a control system of the printing apparatus 50 of this embodiment. As illustrated in FIG. 3, the printing apparatus 50 of this embodiment includes a control unit 100. The control unit 100 controls driving of the drive mechanism 16 and the printing head 1 based on a detection signal from a detection unit. The detection unit may be, for example, an ink detection unit 17 that detects the amount of the ink in the reservoir tank 4, an ink tank detection sensor 18 that detects attaching and detaching of the ink tank, a printing head detection sensor (printing head detection unit) 21 that detects attaching and detaching of the printing head 1, and the like. Additionally, a roll sheet detection sensor 22 and the like that detect attachment and detachment of the roll sheet are also provided as the detection unit. The drive mechanism 16 is a mechanism that uses drive force from a common drive source 16*a* to, for example, open and close various valves including the valves illustrated in FIG. 2 and expand and contract the flexible portion 33.

The control unit 100 includes a CPU 11 that controls driving of the units of the printing apparatus, a ROM 13 storing a control program to be executed by the CPU 11, a RAM 14 to be used for operating the control program, an input and output unit (I/O) 15, and so on. The CPU 11 controls driving of the printing head 1, the operation panel 54 including a display unit as a notification unit, the drive source 16*a*, the suction pump 31 provided in the recovery unit 70, an elevating mechanism that makes the cap 35 rises and falls, and the like. The CPU 11 thus functions as a notification control unit that controls the notification unit (the display unit of the operation panel 54), which makes a notification for prompting a preparation operation for the printing (attaching operation of the printing head 1 and attaching operation of the roll sheet). Additionally, the CPU 11 functions as a supply control unit that controls the above-described first and second supply units.

2. Initial Installation Processing

Figure 4:
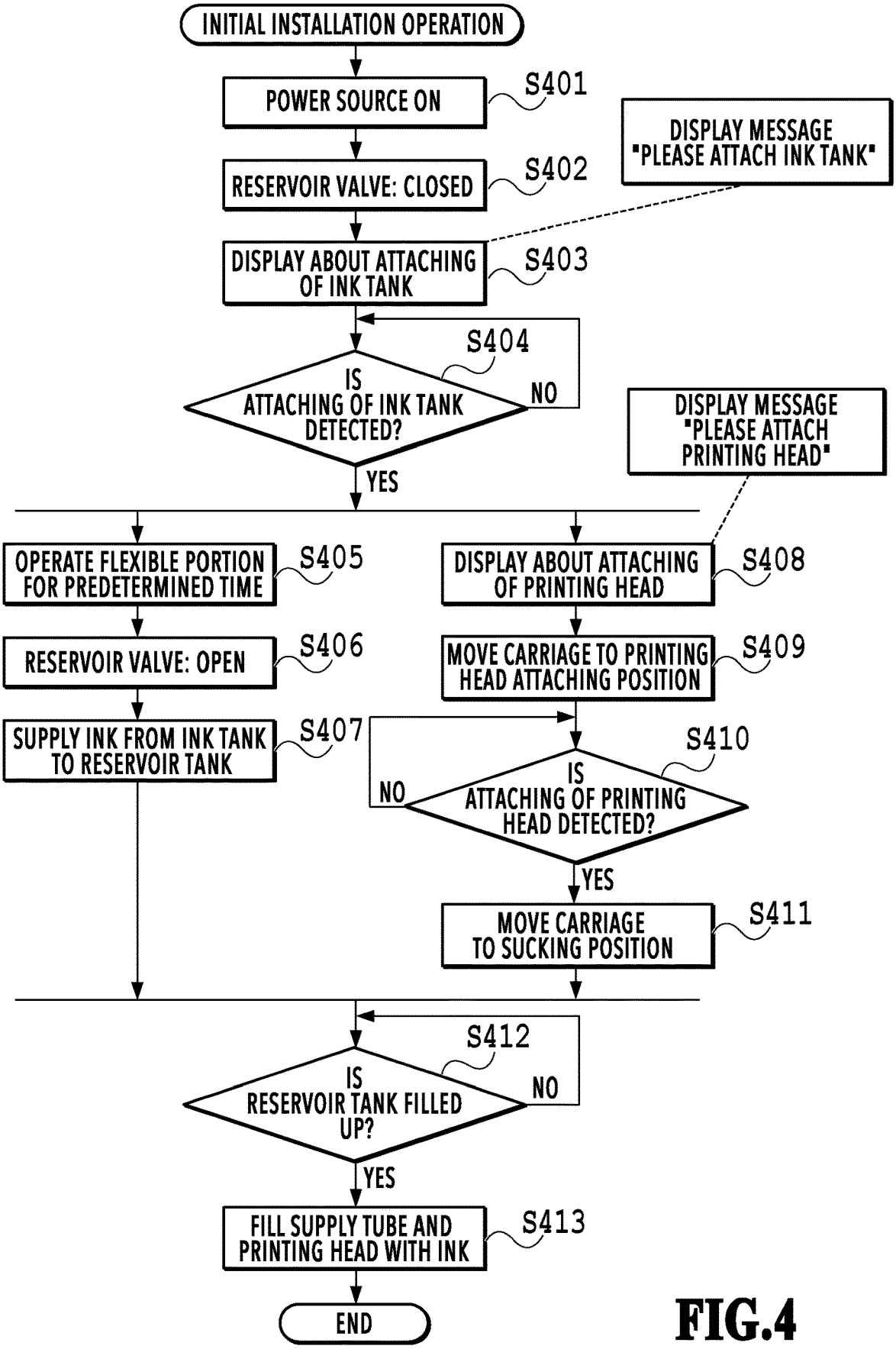
FIG. 4 is a flowchart illustrating procedures of an initial installation processing of the first embodiment.

In the case of using the printing apparatus 50 for the first time, it is required to perform an initial installation processing. Hereinafter, the initial installation processing performed in this embodiment is described with reference to FIGS. 4 and 5A to 5F. FIG. 4 is a flowchart illustrating procedures of the initial installation processing of this embodiment executed by the CPU 11 of the control unit 100. FIGS. 5A to 5F are conceptual diagrams illustrating in stages a state of the ink flow channel of this embodiment. In the flowcharts (FIGS. 4, 6A, 6B, 8A, 8B, 11A and 11B) referred to in the descriptions below, S given with each step number means a step.

Figure 5A:
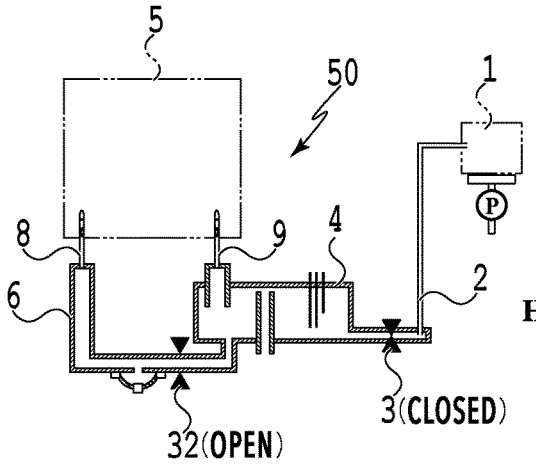
FIGS. 5A to 5F are conceptual diagrams illustrating in stages a state of the ink flow channel illustrated in FIG. 2.

FIG. 5A illustrates a state in which the initial installation is started, and in the printing apparatus 50 in this state, the ink tank 5 and the printing head 1 are not attached to the printing apparatus main body 50*a*. The reservoir valve 32 is opened, and the supply valve 3 is closed.

Figure 5D:
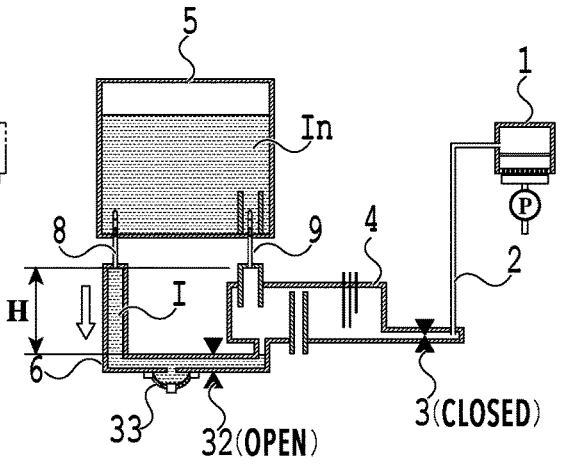
Figure 5B:
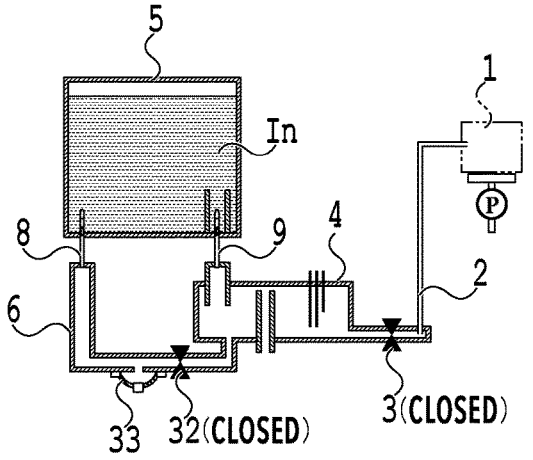

Once the power source of the printing apparatus 50 is activated (ON) (S401), the reservoir valve 32 is closed (S402) as illustrated in FIG. 5B, and the operation panel 54 displays a notification prompting the user to attach the ink tank 5 (S403). For example, an instruction such as "Please attach the ink tank" is displayed. In response to the displayed notification, the user attaches the ink tank 5 to the printing apparatus main body 50*a*. The first hollow tube 8 and the second hollow tube 9 are thereby inserted in the joint portions 51 and 52 of the ink tank 5, respectively.

Figure 5E:
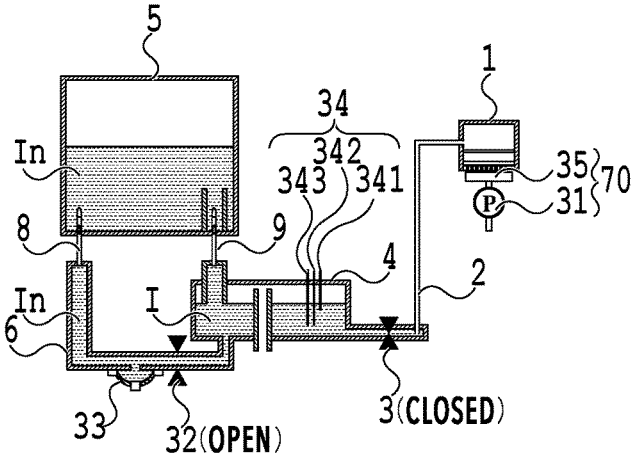
Figure 5C:
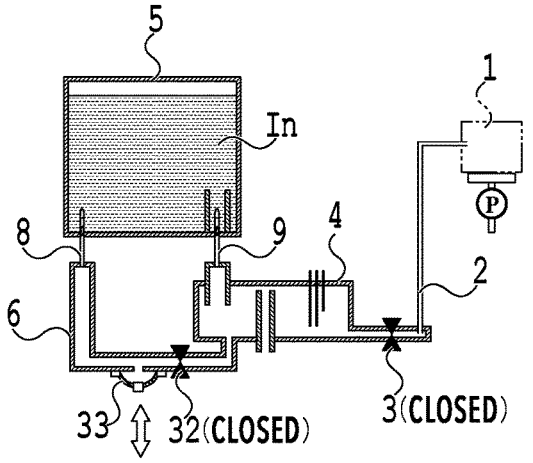

Once the ink tank detection sensor 18 detects that the ink tank 5 is attached to the printing apparatus main body 50*a* (S404), the flexible portion 33 is operated for a predetermined period of time to fill the ink supply channel 6 with the ink (S405). Specifically, the flexible portion 33 is deformed (contraction deformation) to decrease the internal volume with the reservoir valve 32 being closed as illustrated in FIG. 5C, and thereby the air in the ink supply channel 6 is pushed out to the ink tank 5 (the air flows out). Next, the flexible portion 33 is deformed (expansion deformation) to increase the internal volume, and thereby the ink is drawn from the ink tank 5 into the ink supply channel 6. Such an operation to vary the volume is repeatedly performed in a predetermined period of time.

The flexible portion 33 and the first hollow tube 8 are formed such that a relationship of V1>V2 is satisfied, where the amount of variation in the volume of the flexible portion 33 is V1 and the volume of inside of the first hollow tube 8 is V2. With the volume of the flexible portion 33 continuously varied, the gas-liquid exchange inside the ink supply channel 6 (the volume V3) between the ink tank 5 and the reservoir valve 32 progresses, and the inside of the ink supply channel 6 is eventually filled with the ink as illustrated in FIG. 5D.

Next, the reservoir valve 32 is opened with the ink supply channel 6 filled with the ink (S406). Consequently, the ink is started to be supplied from the ink tank 5 to the reservoir tank 4 (S407) by the bird-feeding supply method using the water head difference, and the ink liquid level increases in the reservoir tank 4. In the meantime, the electrode 34 (the first metal shaft 341 and the third metal shaft 343) is used to detect whether the reservoir tank 4 is filled up with the supplied ink (S412).

In this embodiment, it takes about 10 seconds from the start of the operation for a predetermined period of time of the flexible portion 33 for filling the ink supply channel 6 with the ink (S405) to the opening of the reservoir valve 32 (S406). Thereafter, it takes about 2 minutes and 30 seconds from the supplying of the ink from the ink tank 5 to the reservoir tank 4 (S407) to the filled-up of the reservoir tank 4. Thus, it requires about 2 minutes and 40 seconds from the start of the supplying of the ink to the ink supply channel 6 to the filled-up of the reservoir tank 4.

In this embodiment, while the ink is supplied to the reservoir tank 4, a notification prompting the user to attach the printing head 1 is displayed. Once the ink tank detection sensor 18 detects the attaching of the ink tank 5 (S404), the operation panel displays the notification prompting the attaching of the printing head 1 (S408), and the carriage 60 is moved to a position in which the printing head 1 can be attached to the carriage 60 (S409). The operation panel 54 displays an instruction such as "Please attach the printing head", for example. In response to the displayed notification, the user attaches the printing head 1 to the carriage 60.

Thereafter, the printing head detection sensor 21 determines whether the attaching of the printing head 1 is detected (S410). Once the attaching of the printing head 1 is detected by the printing head detection sensor 21, the carriage 60 is moved to the sucking position facing the recovery unit 70 (S411) to allow the ink in the printing head 1 to be sucked out by the recovery unit 70.

In this embodiment, it takes about 1 minute from the moment in which the operation panel 54 displays the notification prompting the attaching of the printing head 1 to the moment in which the attaching of the printing head 1 to the printing apparatus main body 50*a* is detected (S408 to S410). Consequently, it is possible to perform the attaching of the printing head 1 until the reservoir tank 4 is filled with the ink through the processings of S405 to S407 (2 minutes and 40 seconds).

Figure 5F:
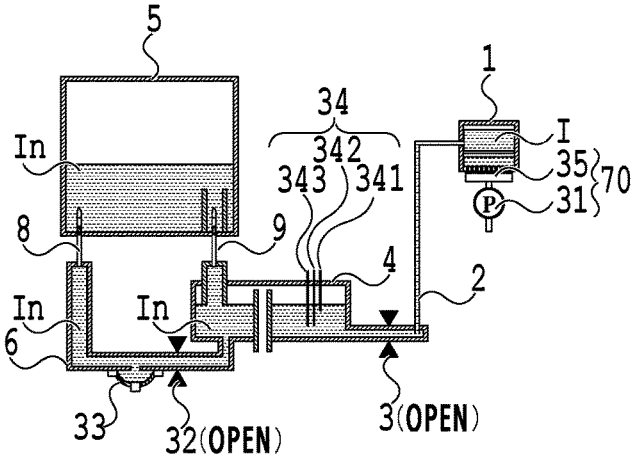

Thereafter, once the first and the second metal shafts 341 and 342 detect that the reservoir tank 4 is filled up with the ink (S412), the ink in the reservoir tank 4 is supplied to the printing head 1 by the sucking operation of the suction pump 31, and the printing head 1 is thus filled with the ink (S413). The space from the supply tube 2 to the printing head 1 is filled with the ink from the reservoir tank 4 as described below. First, as illustrated in FIG. 5E, the elevation mechanism of the cap is operated to attach the cap 35 closely to the ejection port surface 1*a* to the printing head 1. Then, the sucking operation by the suction pump 31 is performed for a predetermined period of time with the supply valve 3 closed, and the negative pressure of the ink in the flow channel portion from the cap 35 to the supply valve 3 through the printing head 1 is increased. Thereafter, the supply valve 3 is opened. Thus, the negative pressure generated in the above-mentioned flow channel portion causes the ink in the reservoir tank 4 to be supplied to the supply tube 2. Repetition of the sucking operation using the cap 35 makes it possible to fill the printing head 1 with the ink as illustrated in FIG. 5F.

As described above, in this embodiment, in the initial installation, after the ink tank 5 is attached, the operation of supplying the ink to the reservoir tank 4 is started, and at the same time the notification for prompting the user to attach the printing head 1 to the printing apparatus main body 50*a* is made by displaying the instruction on the operation panel 54. With the user attaching the printing head 1 in response to the displayed notification, it is possible to finish the attaching of the printing head 1 while finishing the filling of the reservoir tank 4 with the ink. Specifically, after the attaching of the ink tank 5 is detected, the operation of supplying the ink to the reservoir tank 4 is started before the attaching of the printing head 1 is detected. Then, once the two facts, the filled-up of the reservoir tank 4 and the attaching of the printing head 1, are detected, the printing head 1 is started to be filled with the ink. In this way, it is possible to speedily start the filling processing of the printing head 1 with the ink after the filling processing of the reservoir tank 4. The time between the attaching of the ink tank 5 and the filling of the printing head 1 with the ink can be reduced, and the time for the initial installation can be reduced.

Figure 6A:
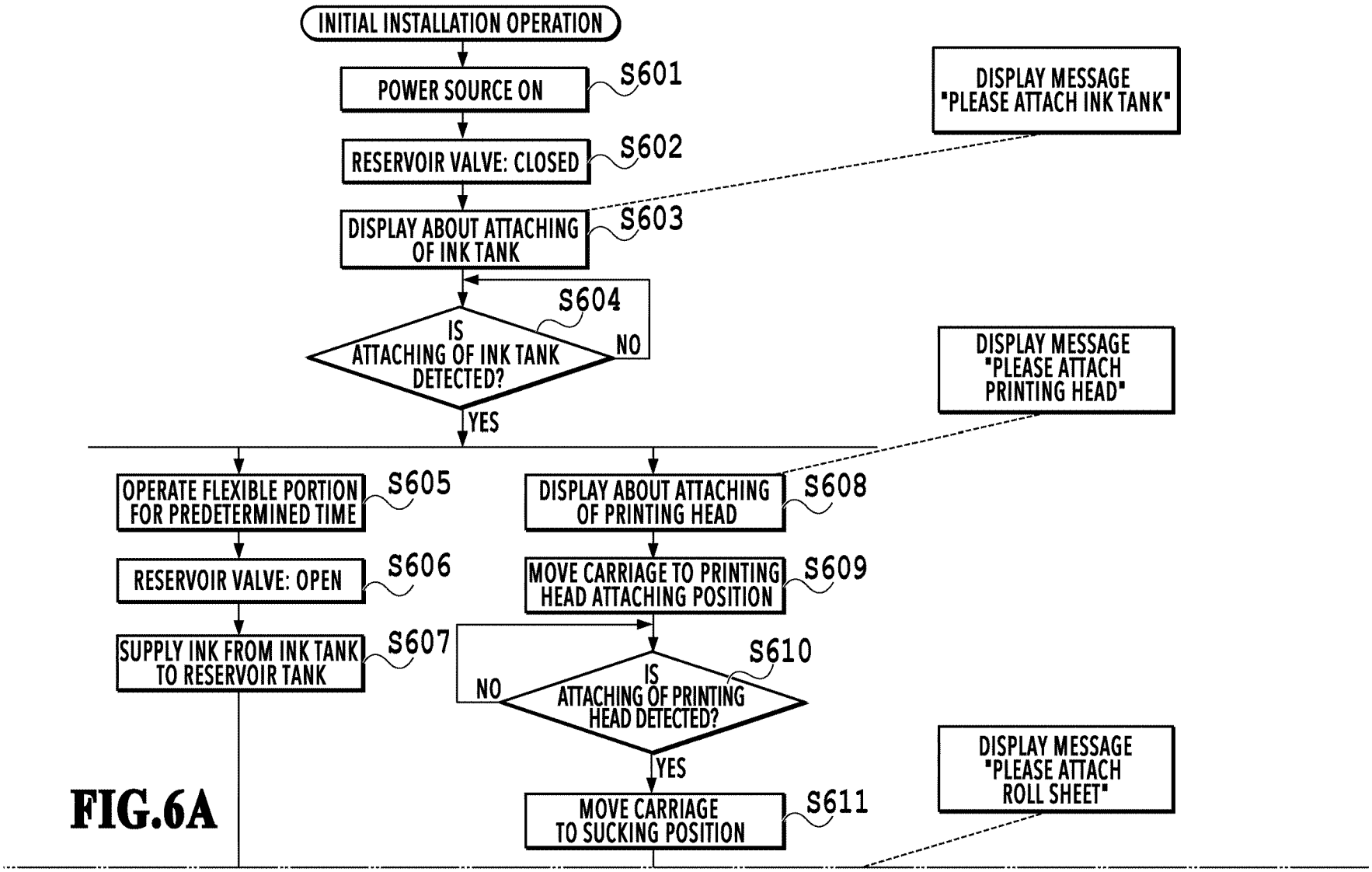
FIGS. 6A and 6B are flowcharts illustrating procedures of an initial installation processing of a modification of the first embodiment.
Figure 6B:
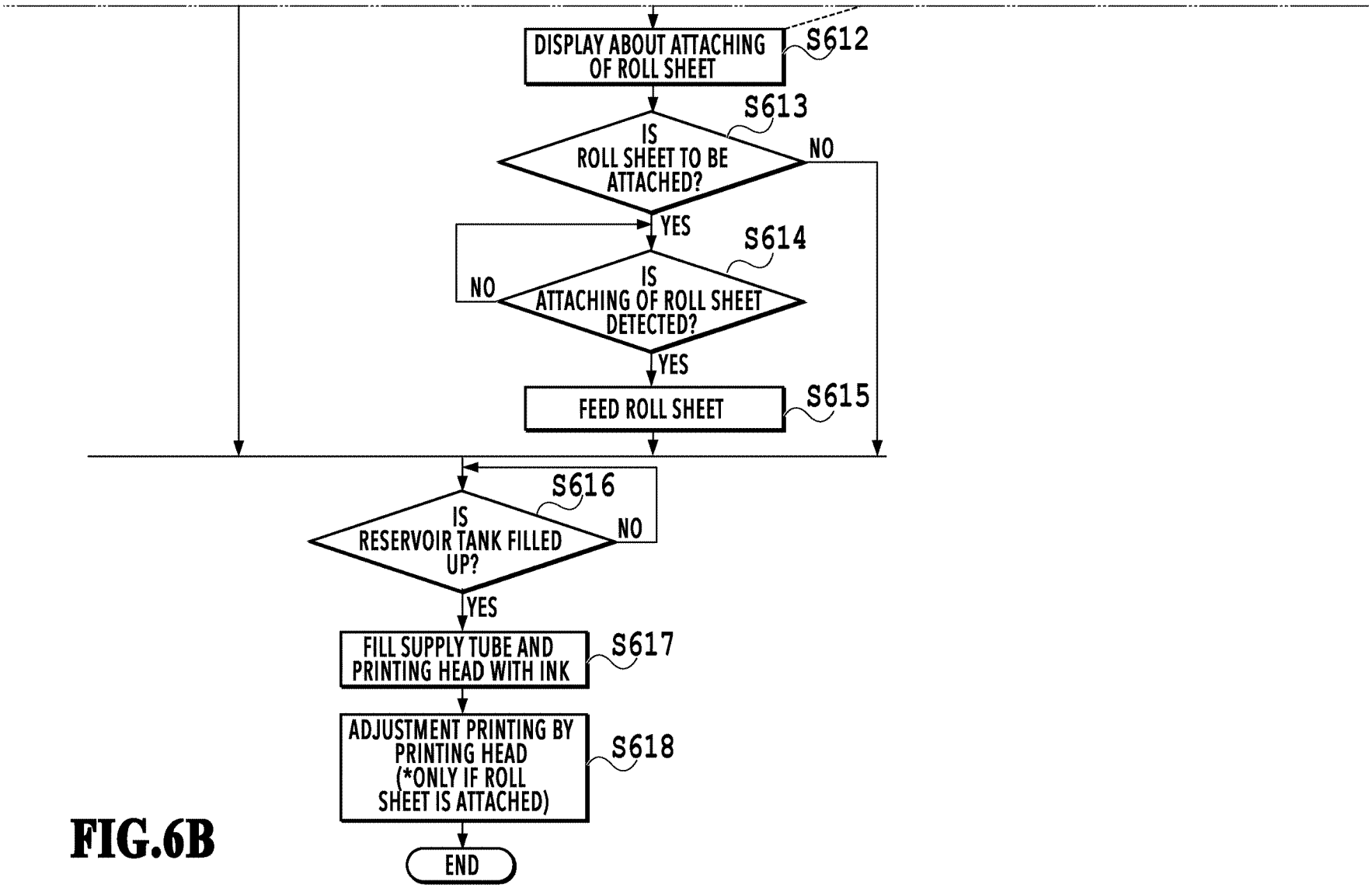

The processing illustrated in FIG. 4 shows the example in which the attaching of the printing head 1 is performed while the ink is being supplied from the ink tank 5 to the reservoir tank 4. However, in addition to the attaching of the printing head 1, attaching of the roll sheet as the printing medium may be performed while the the ink is being supplied to the reservoir tank 4. Usually, after the initial installation, the printing head 1 performs adjustment printing to confirm the printing state and make adjustment. For this, if the roll sheet is attached before the printing head 1 is filled with the ink, the printing head 1 can perform the adjustment printing automatically after the printing head 1 is filled with the ink, like a modification of this embodiment described below (FIGS. 6A and 6B).

Hereinafter, the modification of this embodiment is described with reference to the flowchart of FIGS. 6A and 6B. In this modification, in the initial installation, the user attaches not only the printing head 1 but also the roll sheet while the ink is being supplied from the ink tank 5 to the reservoir tank 4. The description with reference to the flowchart illustrated in FIGS. 6A and 6B are given mainly based on the different points from the flowchart of FIG. 4.

Once the power source of the printing apparatus 50 is activated (ON) (S601), reservoir valve 32 is closed (S602), and the notification prompting the attaching of the ink tank 5 is displayed (S603). The user attaches the ink tank 5 to the printing apparatus main body 50*a* in response to the displayed notification. Once the ink tank detection sensor 18 detects the attaching of the ink tank 5 (S604), the ink supply channel 6 is started to be filled with the ink and the reservoir tank 4 is started to be supplied with the ink (S605 to S607). Those filling of the ink supply channel 6 with the ink and supplying of the reservoir tank 4 with the ink (S605 to S607) are performed similarly to S405 to S407 of the first embodiment.

While the reservoir tank 4 is being supplied with the ink, the notification prompting the attaching of the printing head 1 is displayed (S608), and the carriage 60 is moved to the attaching position of the printing head 1 (S609). In response to the displayed notification, the user attaches the printing head 1 to the carriage 60. Thereafter, once the printing head detection sensor 21 detects the attaching of the printing head 1 (S610), the carriage 60 is moved to the sucking position facing the recovery unit 70 (S611).

Next, a notification prompting the attaching of the roll sheet is displayed on the operation panel 54 (S612). For example, an instruction such as "Please attach the roll sheet" is displayed. Then, the user performs a setting operation to indicate whether to attach the roll sheet to the printing apparatus main body 50*a* through the operation panel 54. Specifically, once the notification prompting the attaching of the roll sheet is displayed, the user can select whether to attach the roll sheet. If the roll sheet is already prepared, the user performs a setting operation to indicate that the user attaches the roll sheet at this point in time. On the other hand, if the roll sheet is not prepared, or if the later-described adjustment printing is not performed, the user performs a setting operation to cancel the attaching of the roll sheet at this point in time. Based on the setting operation performed by the user, whether the roll sheet is to be attached to the printing apparatus main body 50*a* at this point in time is determined in S613, and if it is determined that the roll sheet is not to be attached, the process proceeds to S616, and if it is determined that the roll sheet is to be attached, the process proceeds to S614.

In S614, it is determined whether the roll sheet detection sensor 22 detects the attaching of the roll sheet. If it is determined that the attaching of the roll sheet is detected, the roll sheet is fed to the printing position of the printing apparatus main body 50*a* (S615), and then the process proceeds to S616. In this embodiment, it takes about 2 minutes from the displaying of the notification prompting the attaching of the roll sheet to the feeding of the roll sheet to the printing position of the printing apparatus 50 (S612 to S615).

In S616, it is determined whether the reservoir tank 4 is filled up. If it is determined that the reservoir tank is filled up (S616), the ink in the reservoir tank 4 is supplied to the printing head 1 by the sucking performed by the suction pump 31 (S617). Thereafter, the printing head 1 performs the adjustment printing (S618). This adjustment printing is executed only if the roll sheet is attached to the printing apparatus main body 50*a*.

In the above-described modification, the example in which the operation panel 54 provided in the printing apparatus main body 50*a* displays the notification prompting the attaching of the ink tank 5, the notification prompting the attaching of the printing head 1, and the notification prompting the attaching of the roll sheet is described. However, a device other than the operation panel 54 may display the notifications displayed like the above to prompt the attaching. For example, a peripheral device connected to the printing apparatus main body 50*a* (such as a display of a personal computer) may display those notifications.

As described above, it is possible to achieve reduction of the time for the initial installation with the user prompted to attach the printing head 1 (about 1 minute) and the roll sheet (about 2 minutes) while the ink is being supplied from the ink tank 5 to the reservoir tank 4 (about 2 minutes and 40 seconds). If the roll sheet is attached while the ink is being supplied to the reservoir tank 4, it is possible to start the adjustment printing automatically after the reservoir tank is filled with the ink, and to reduce the waiting time until the printing starts.

Second Embodiment

A second embodiment of the present invention is described with reference to FIGS. 7 and 9A to 9F. The second embodiment has a similar configuration with that of the first embodiment, and the description is given mainly based on the different points from the first embodiment.

Figure 7:
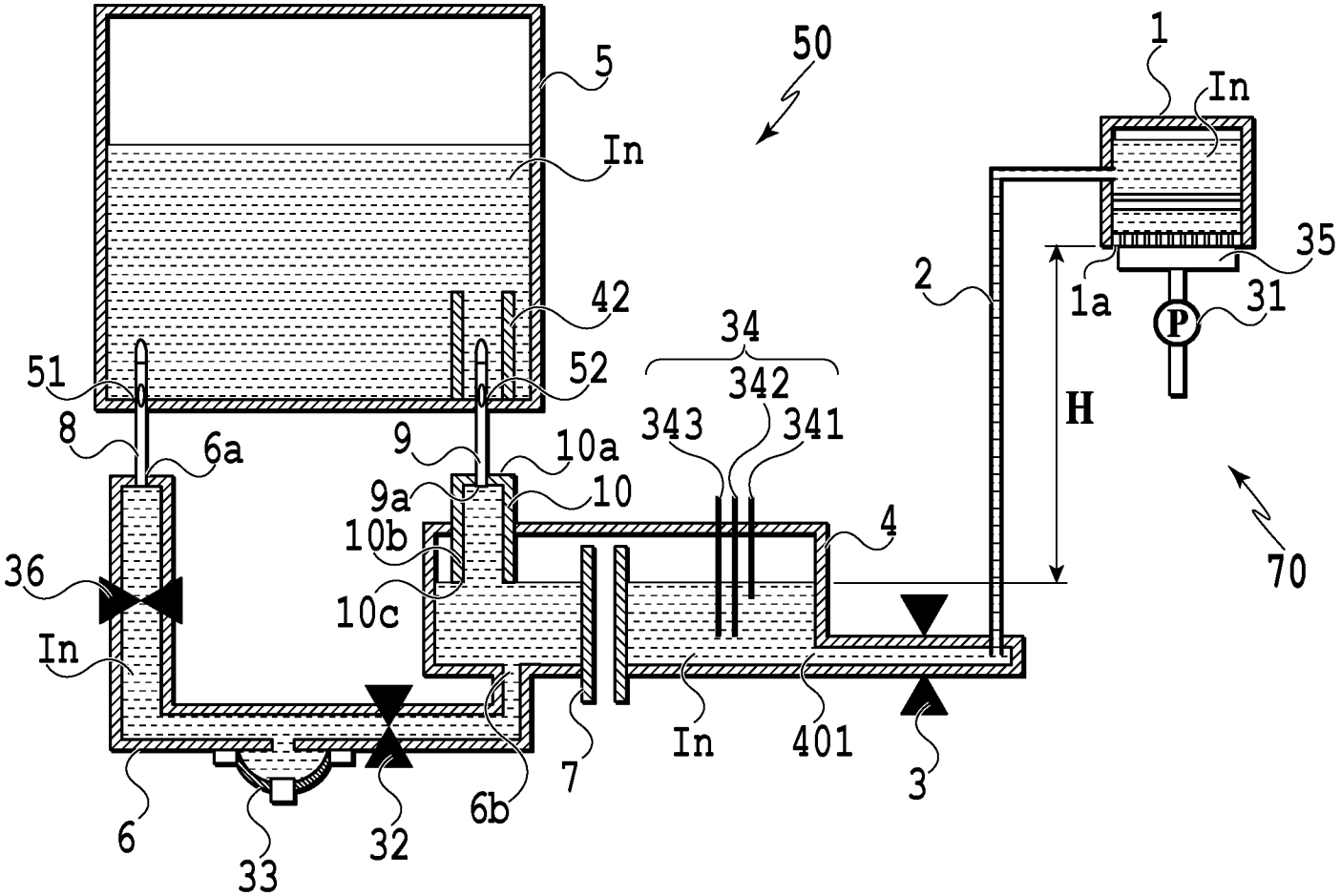
FIG. 7 is a conceptual diagram of an ink flow channel of an ink jet printing apparatus of a second embodiment.

FIG. 7 is a conceptual diagram of an ink flow channel of a printing apparatus 50 of the second embodiment. Although there are provided the multiple ink flow channels for the respective ink colors, an ink flow channel of one color is described herein since the ink flow channels have the same configuration in this embodiment as well.

The ink supply channel 6 is provided with the flexible portion 33, the reservoir valve 32, and a main valve 36 as a first supply unit for supplying the ink from the ink tank 5 to the reservoir tank 4. The flexible portion 33 and the reservoir valve 32 are the same as those described in the first embodiment. The main valve 36 is arranged between the flexible portion 33 and the end portion 6*a* of the ink supply channel 6. The reservoir valve 32, the main valve 36, the flexible portion 33, and the supply valve 3 are driven by the drive mechanism (not illustrated) including the common drive source (for example, motor) 16*a*, and the drive source 16*a* is controlled by the CPU 11. Thus, the CPU 11 functions as a supply control unit to control the driving of the first supply unit of the present invention. The other part of the configuration is similar to that of the first embodiment.

Figure 8A:
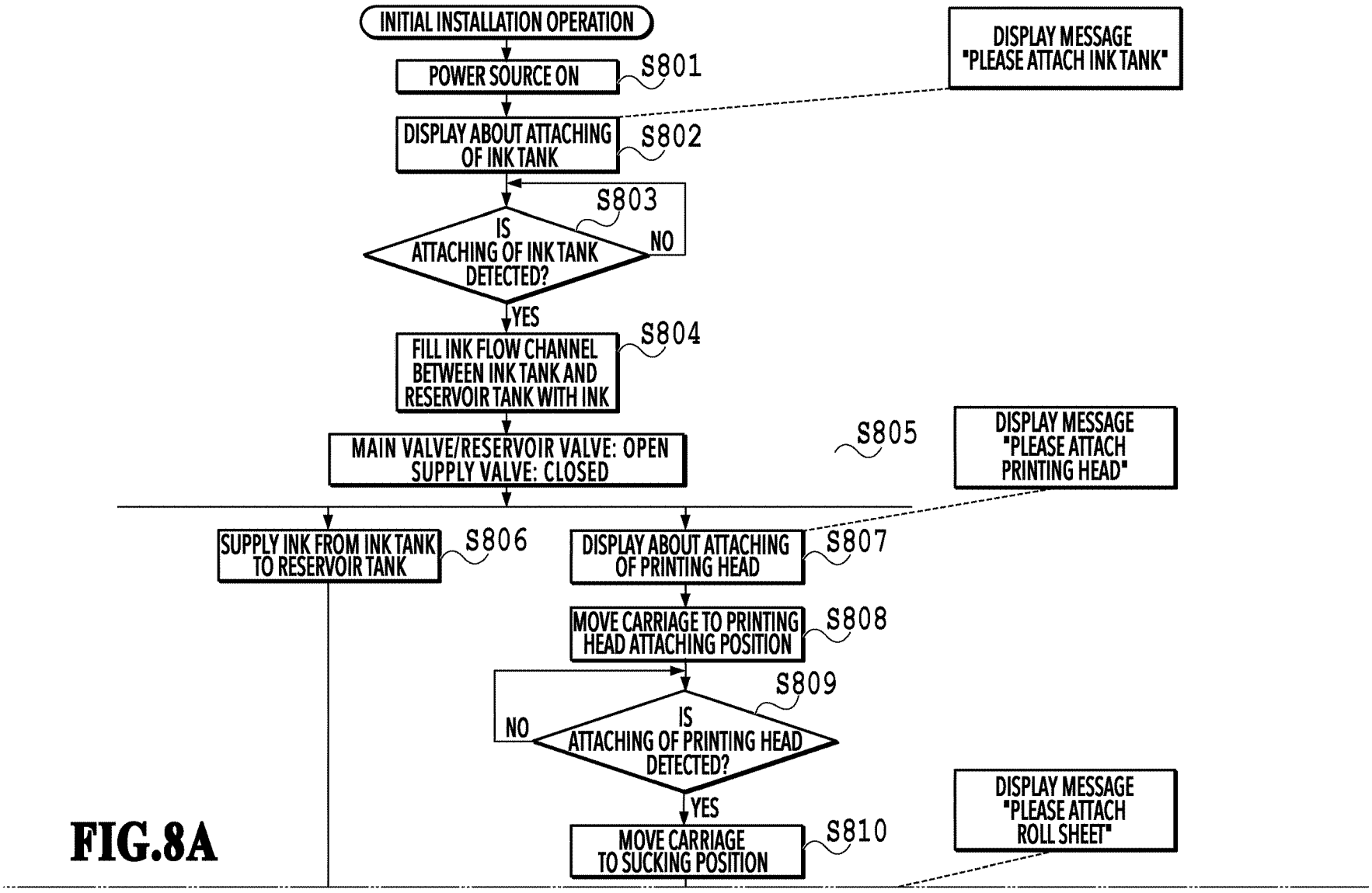
FIGS. 8A and 8B are flowcharts illustrating procedures of an initial installation processing of the second embodiment.
Figure 8B:
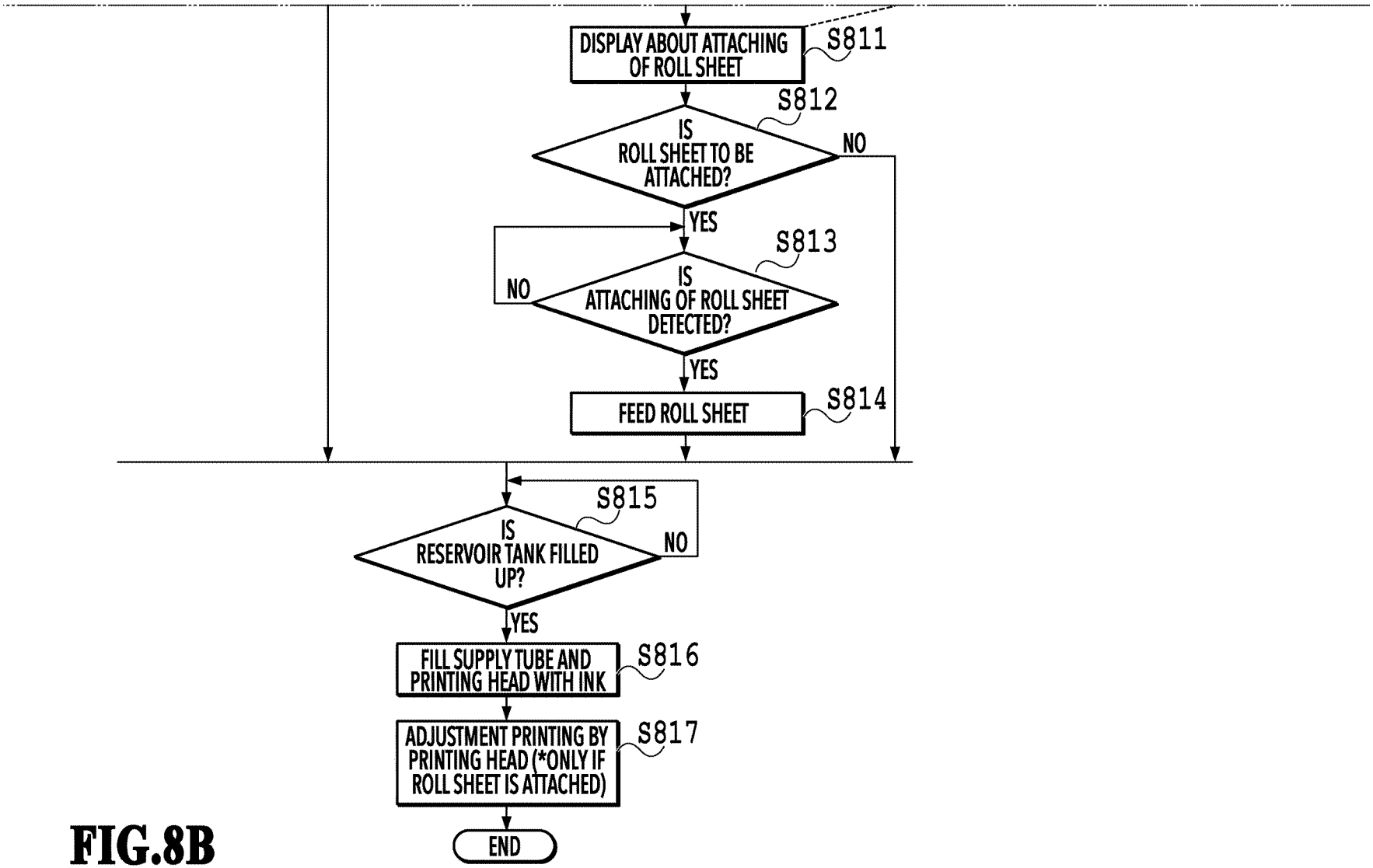

Next, an initial installation processing performed by the printing apparatus 50 of this embodiment is described with reference to FIGS. 8A, 8B and 9A to 9F. FIGS. 8A and 8B are flowcharts illustrating the initial installation processing executed by the CPU 11 (FIG. 3). FIGS. 9A to 9F are conceptual diagrams illustrating in stages a state of the ink flow channel in the initial installation of this embodiment.

Figure 9A:
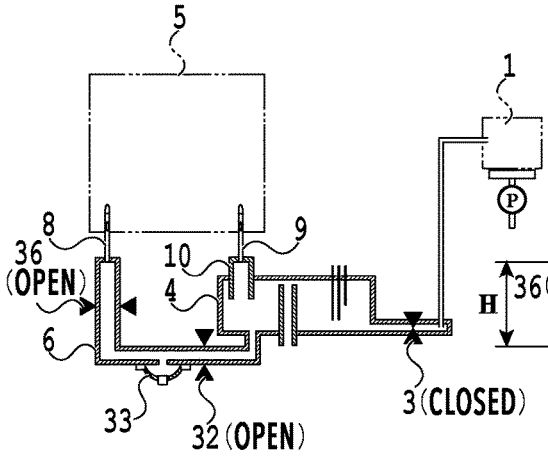
FIGS. 9A to 9F are conceptual diagrams illustrating in stages a filling state of ink in the ink flow channel illustrated in FIG. 7.

FIG. 9A illustrates a state in which the initial installation is started, and in this state, the ink tank 5 and the printing head 1 are not attached to the printing apparatus main body 50*a*. The reservoir valve 32 and the main valve 36 are opened, and the supply valve 3 is closed.

Figure 9D:
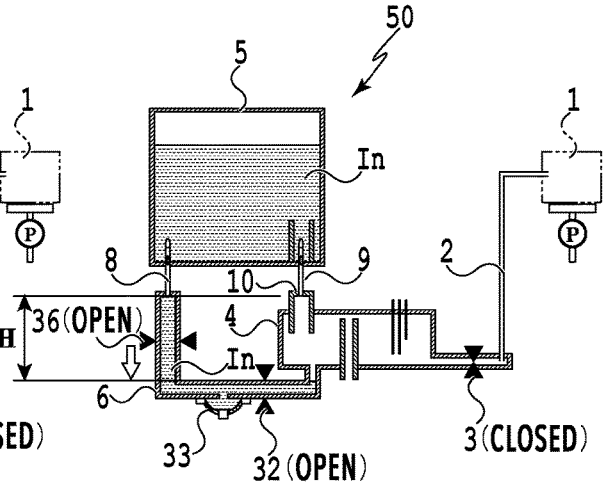
Figure 9B:
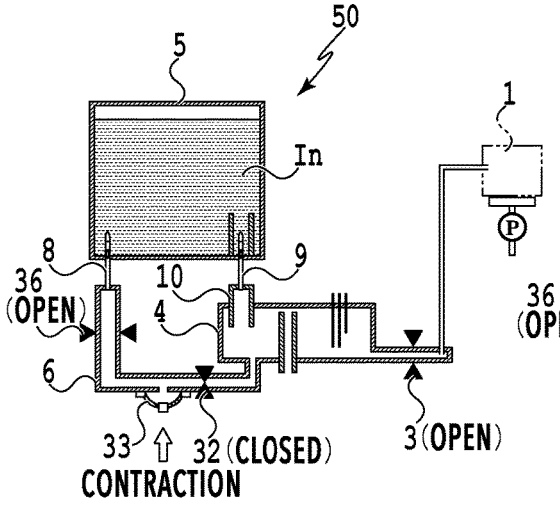
Figure 9E:
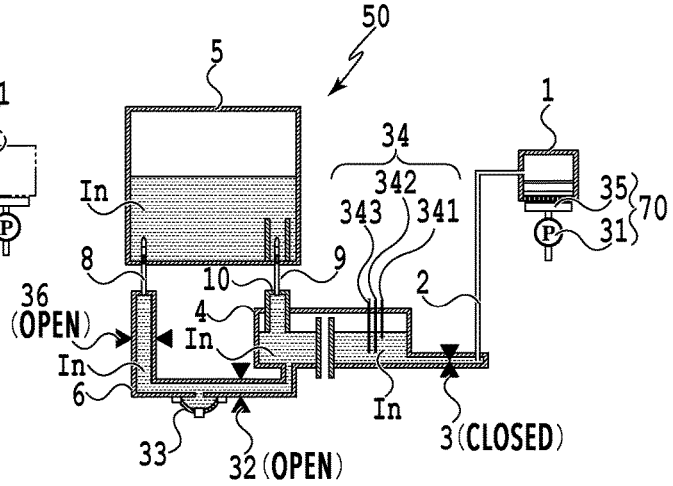

Once the power source of the printing apparatus 50 is activated (ON) (S801), the operation panel 54 displays the notification prompting the attaching of the ink tank 5 to the printing apparatus main body 50*a* (S802). In response to the displayed notification, the user attaches the ink tank 5 to the printing apparatus main body 50*a* as illustrated in FIG. 9B. Once the ink tank detection sensor 18 detects the attaching of the ink tank 5 (S803), the ink supply channel 6 is started to be filled with the ink (S804).

Figure 9C:
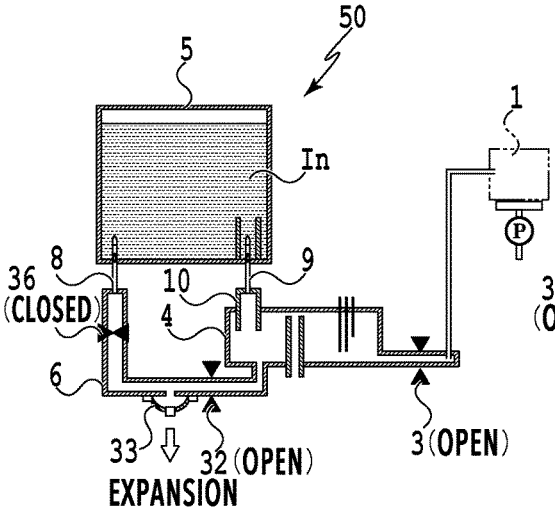
Figure 9F:
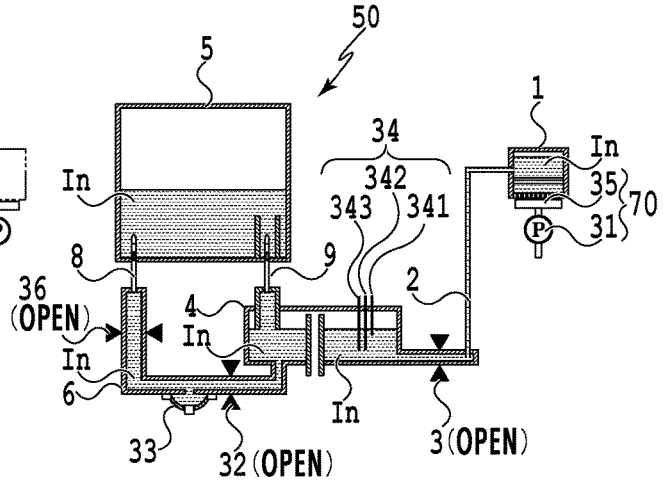

Specifically, as illustrated in FIG. 9B, the volume of the flexible portion 33 is decreased while the reservoir valve 32 is closed and the main valve 36 and the supply valve 3 are opened. Thereafter, as illustrated in FIG. 9C, the volume of the flexible portion 33 is increased while the reservoir valve 32 is opened and the main valve 36 is closed. With this operation repeated, there is generated a flow of the ink circulating from the reservoir tank 4 to the ink supply channel 6, the ink tank 5, the air introduction channel 10, and the reservoir tank 4. Consequently, the air in the ink supply channel 6 is pushed out to the ink tank 5, and thereby the ink is supplied from the ink tank 5 to the reservoir tank 4 through the air introduction channel 10. The above-described operation allows the ink supply channel 6 to be filled with the ink as illustrated in FIG. 9D. As described above, the reservoir valve 32, the main valve 36, the flexible portion 33, and the supply valve 3 are driven by the common drive source, and the supply valve 3 is opened while the flexible portion 33 is being driven as illustrated in FIGS. 9B and 9C.

Next, as illustrated in FIG. 9D, the reservoir valve 32 and the main valve 36 are opened, and the supply valve 3 is closed (S805) with the ink supply channel 6 filled with the ink. Consequently, the ink is started to be supplied from the ink tank 5 to the reservoir tank 4 (S806) by the bird-feeding supply method using the water head difference.

In this embodiment, it requires about 2 minutes and 30 seconds from the start of the supplying of the ink from the ink tank 5 to the reservoir tank 4 (S806) to the filled-up of the reservoir tank 4. Simultaneously, the notification prompting the user to attach the printing head 1 to the printing apparatus main body 50*a* is made. Specifically, once the ink is started to be supplied from the ink tank 5 to the reservoir tank 4 (S806), the operation panel 54 displays the notification prompting the attaching of the printing head 1 (S807), and the carriage 60 is moved to the position in which the printing head can be attached to the carriage 60 (S808).

In the above-described first embodiment, the notification prompting the attaching of the printing head 1 is displayed during the operation of filling the ink supply channel 6 provided between the ink tank 5 and the reservoir tank 4 with the ink. On the contrary, in the second embodiment, since the supply valve 3 is opened during the operation of filling the ink supply channel 6 with the ink, the operation panel 54 displays the notification prompting the attaching of the printing head 1 (S807) after the ink supply channel 6 is filled with the ink and the supply valve 3 is closed (S805). This is because, if the supply tube 2 is not sufficiently filled with the ink and the carriage 60 is operated with the supply valve 3 opened, there is a risk that the ink for the inspection stored in the printing head 1 may be dropped from the ejection port by being pressurized by the air in the supply tube 2.

Thereafter, based on an output from the printing head detection sensor 21, it is determined whether the printing head 1 is attached to the carriage 60 (S809). Once the printing head detection sensor 21 detects the attaching of the printing head 1, the carriage 60 is moved to the position facing the recovery unit 70 (sucking position) (S810) to allow the recovery unit 70 to suck out the ink from the printing head 1.

Next, the notification prompting the attaching of the roll sheet is displayed (S811). For example, the instruction such as "Please attach the roll sheet" is displayed. Thereafter, in S812, it is determined whether the roll sheet is to be attached to the printing apparatus main body 50*a* at this point in time. This determination is made based on the setting operation by the user similarly to the processing of S613 in the modification of the above-described first embodiment. If it is determined that the roll sheet is not to be attached, the process proceeds to S815, and if it is determined that the roll sheet is to be attached, the process proceeds to S813.

In S813, it is determined whether the roll sheet detection sensor 22 detects the attaching of the roll sheet. Once the attaching of the roll sheet is detected, a sheet fed out from the roll sheet is subsequently transported to the printing position of the printing apparatus 50 (S814), and the process proceeds to S815.

In S815, it is determined whether the reservoir tank 4 is filled up. If it is determined that the reservoir tank is filled up (S815), the ink in the reservoir tank 4 is supplied to the printing head 1 by the sucking performed by the suction pump 31 (S816). Thereafter, if the roll sheet is attached to the printing apparatus main body 50*a*, the printing head 1 performs the adjustment printing (S817).

If the ink tank 5 is detached during the operation of supplying the ink from the ink tank 5 to the reservoir tank 4 in FIGS. 9B and 9C, the ink supplying operation is stopped. This is for preventing leaking of the ink from the first hollow tube 8 and contamination of the periphery with the ink. If there is provided a configuration in which an ink tank cover (not illustrated) that opens and closes during attaching and detaching of the ink tank 5 is provided and the opening and the closing of the ink tank cover are detected by a cover sensor, it is possible to stop the ink supplying operation in the case where the ink tank cover is opened.

If the ink tank 5 is once detached and then attached again and immediately the ink is started to be supplied from the ink tank 5 to the reservoir tank 4, there is a concern that the ink may be dropped from the ejection port of the printing head 1. Specifically, since the supply valve 3 is opened during the operation of supplying the ink to the reservoir tank 4, if the carriage 60 is operated as described above, the ink for examination in the printing head 1 may be dropped from the ejection port of the printing head 1. To deal with this, the operation of supplying the ink from the ink tank 5 to the reservoir tank 4 is started again after the supply valve 3 is closed, the printing head 1 is attached, and the carriage 60 is moved to the sucking position facing the recovery unit 70.

As described above, it is possible to reduce the time for the initial installation by attaching the printing head 1 and the roll sheet to the printing apparatus 50 during the operation of supplying the ink from the ink tank 5 to the reservoir tank 4.

Third Embodiment

Hereinafter, a third embodiment of the present invention is described with reference to FIGS. 10, 11, and 12A to 12E. The following description is given mainly based on the different points from the first and second embodiments.

The first embodiment and the second embodiment show the example of the printing apparatus that employs the bird-feeding supply method for supplying the ink to the reservoir tank. On the contrary, a printing apparatus 50 of the third embodiment fills the reservoir tank with the ink by a supply method different from the bird-feeding method.

Figure 10:
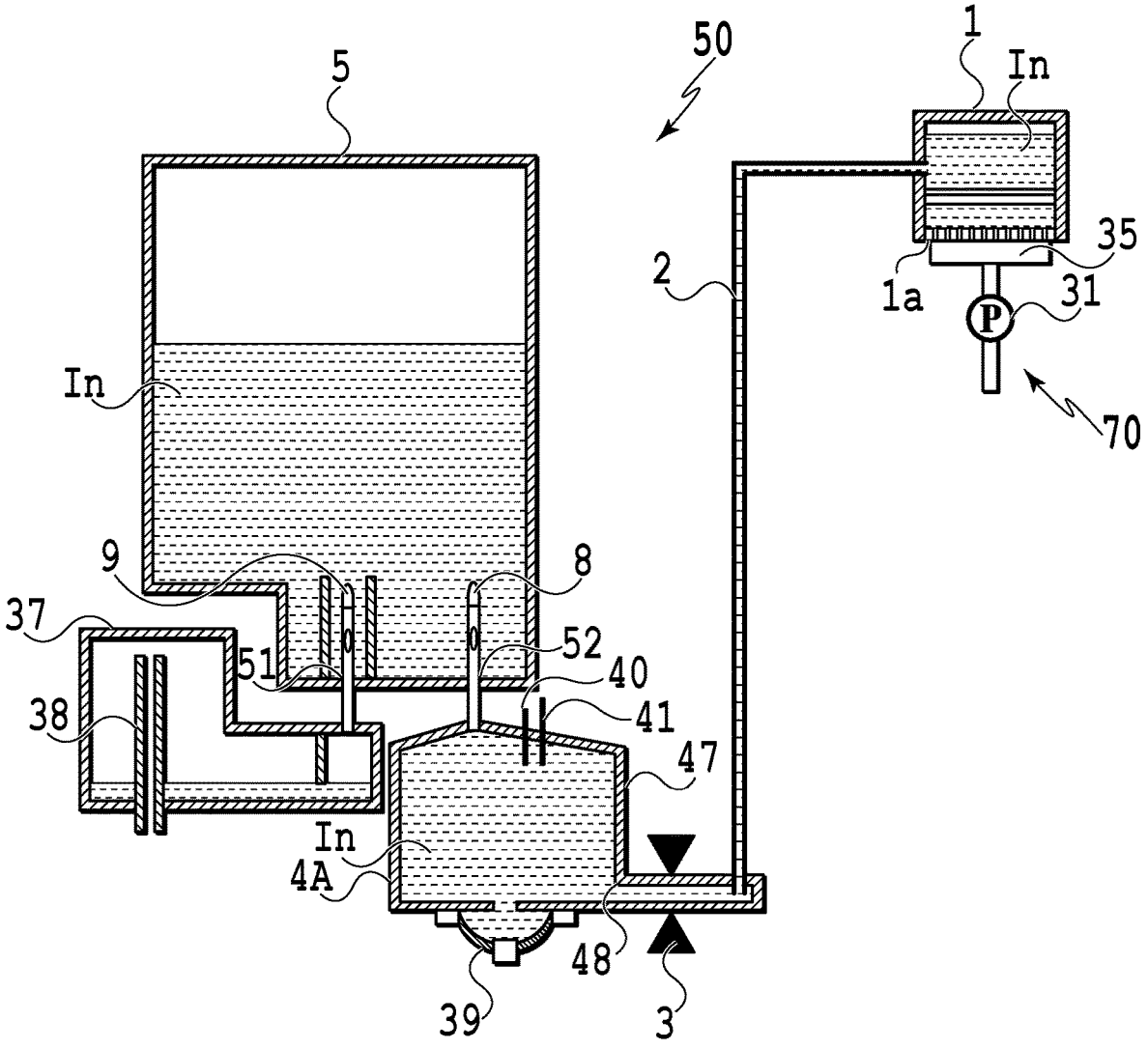
FIG. 10 is a conceptual diagram of an ink flow channel of an ink jet printing apparatus of a third embodiment.

FIG. 10 is a conceptual diagram of an ink flow channel of the ink jet printing apparatus 50 of this embodiment. Although there are provided the multiple ink flow channels for the respective ink colors, an ink flow channel of one color is described herein since the ink flow channels have the same configuration in this embodiment as well.

As illustrated in FIG. 10, the printing apparatus 50 of this embodiment includes the ink tank 5, the reservoir tank 4A, the printing head 1, and an air communication chamber 37 communicated with the atmospheric air through an air communication channel 38. The reservoir tank 4 and the air communication chamber 37 are held by the printing apparatus main body 50*a* of the printing apparatus 50 (see FIG. 1).

Like the first embodiment, the bottom section of the ink tank 5 is provided with the joint portions 51 and 52. These joint portions 51 and 52 allow the inserting and the removing of the first hollow tube 8 and the second hollow tube 9 provided in the printing apparatus main body 50*a*. The second hollow tube 9 is held by the air communication chamber 37. The air communication chamber 37 is communicated with the atmospheric air through the air communication channel 38. The first hollow tube 8 is held so as to be communicated with the inside of a reservoir tank 4A.

With the ink tank 5 attached to the printing apparatus main body 50*a*, the first hollow tube 8 and the second hollow tube 9 as connection portions that can be connected to the ink tank 5 pass through the joint portions 51 and 52 and are inserted to the inside of the ink tank 5, respectively. Thus, the ink tank 5 is communicated with the atmospheric air through the second hollow tube 9 and the air communication channel 38 of the air communication chamber 37 and is also communicated with the reservoir tank 4A through the first hollow tube 8.

The reservoir tank 4A is connected to the printing head 1 through the supply tube 2. The supply tube 2 is connected to a flow-out port 48 formed in the lowest position on a side surface of the reservoir tank 4A. The supply valve 3 (open-close valve) that switches between the communication and the interruption of the reservoir tank 4A and the supply tube 2 is provided between the reservoir tank 4A and the supply tube 2. The bottom section of the reservoir tank 4A is provided with a flexible portion 39 in which the internal volume can be varied. In this embodiment, the amount of variation in the volume of the flexible portion 39 is set to about 0.7 to 1 milliliters. It should be noted that the arrangement or the internal volume of the flexible portion 39 can be varied as appropriate.

The reservoir tank 4A is provided with a first metal shaft 40 and a second metal shaft 41. It is possible to detect whether the ink liquid surface in the reservoir tank 4A reaches tip ends of the first metal shaft 40 and the second metal shaft 41 by applying a predetermined voltage between the two metal shafts 40 and 41 to see whether the two metal shafts 40 and 41 have the electrical connection. The other part of the configuration is similar to that of the above-described first embodiment.

Figure 11A:
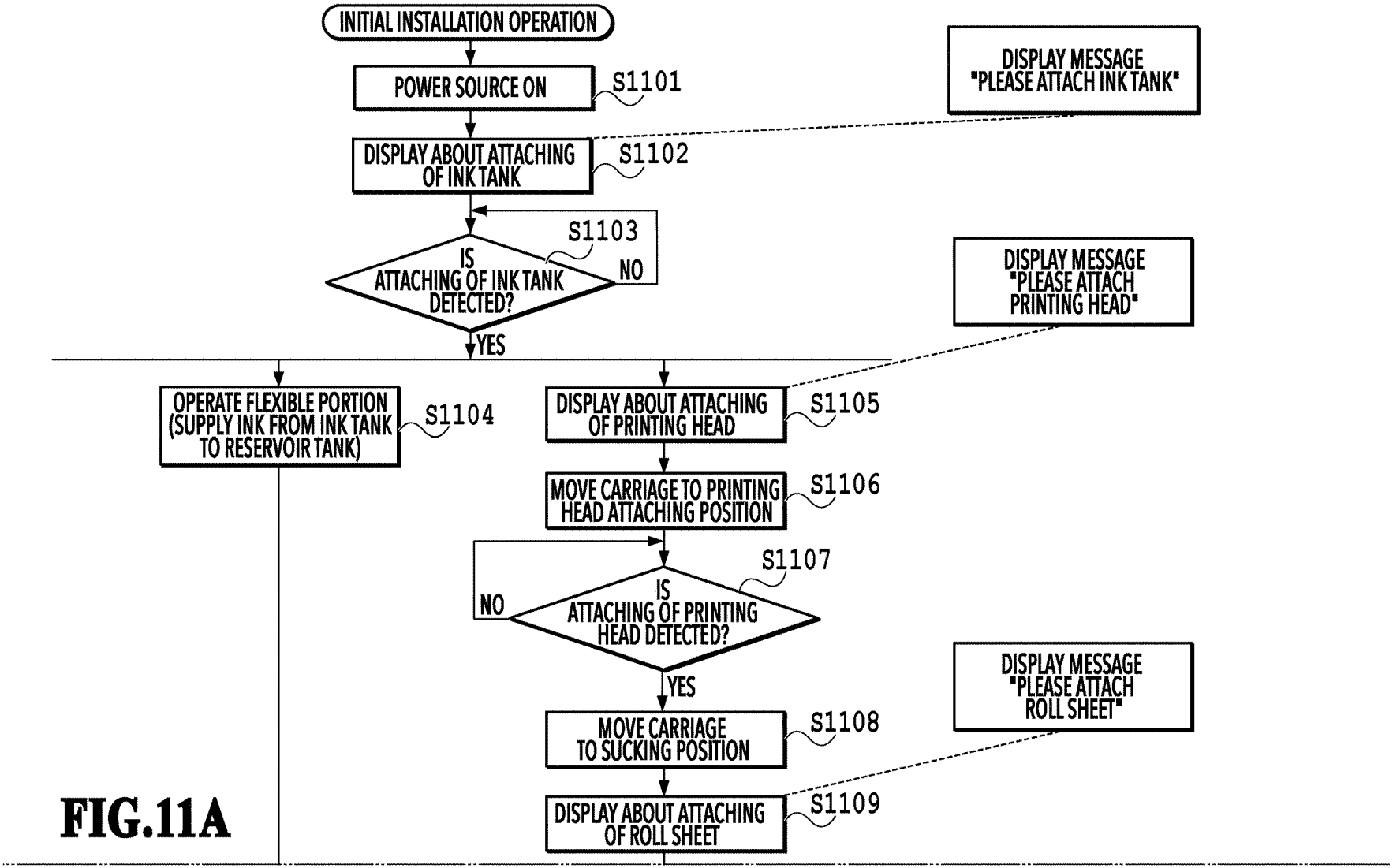
FIGS. 11A and 11B are flowcharts illustrating procedures of an initial installation processing of the third embodiment.
Figure 11B:
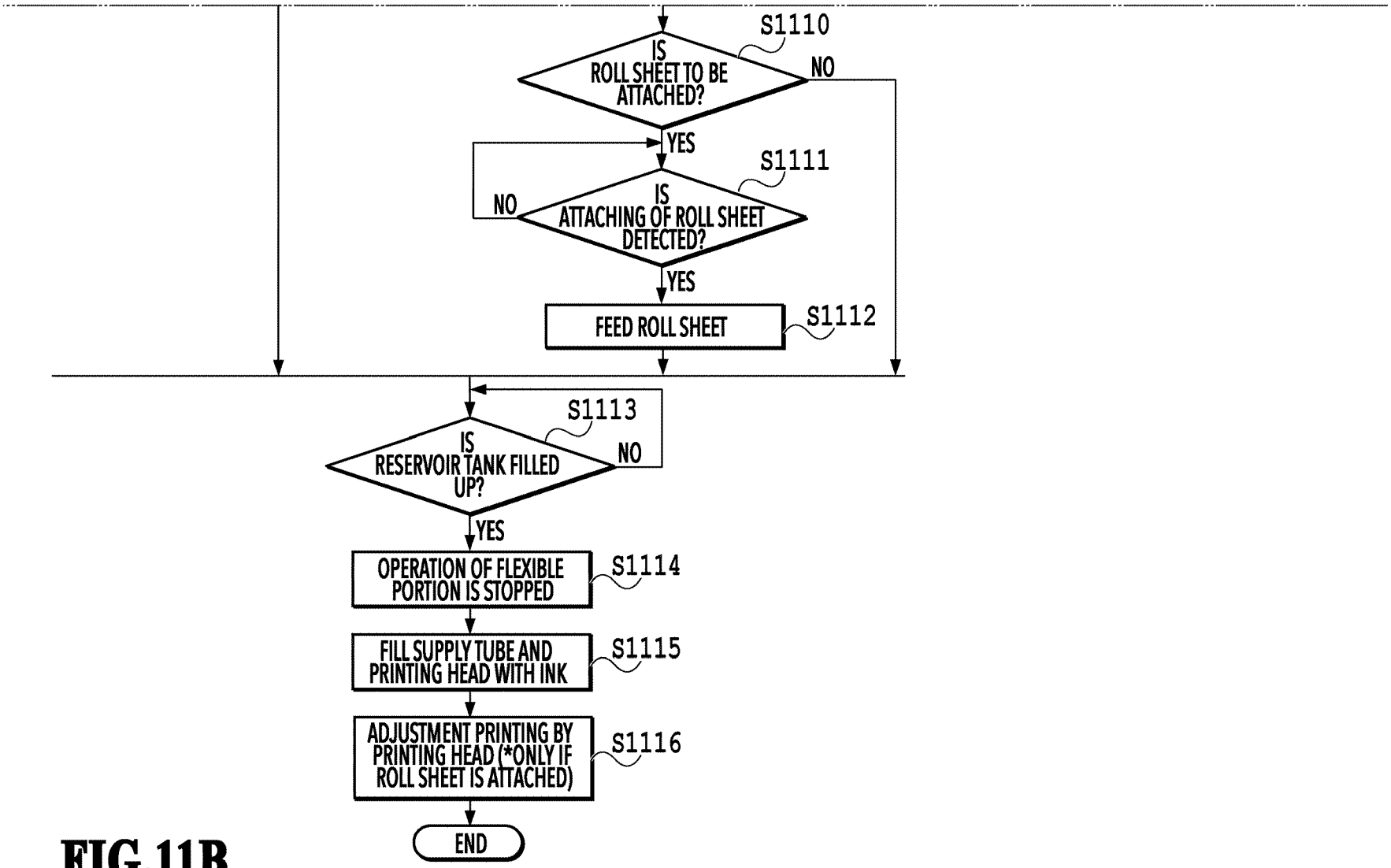

Next, an initial installation processing of the printing apparatus 50 of the third embodiment having the above-described configuration is described with reference to FIGS. 11A, 11B and 12A to 12E. FIGS. 11A and 11B are flowcharts illustrating procedures of the initial installation processing executed by the CPU 11 (FIG. 3). FIGS. 12A to 12E are conceptual diagrams illustrating in stages a state of the ink flow channel in the initial installation of this embodiment.

Figure 12A:
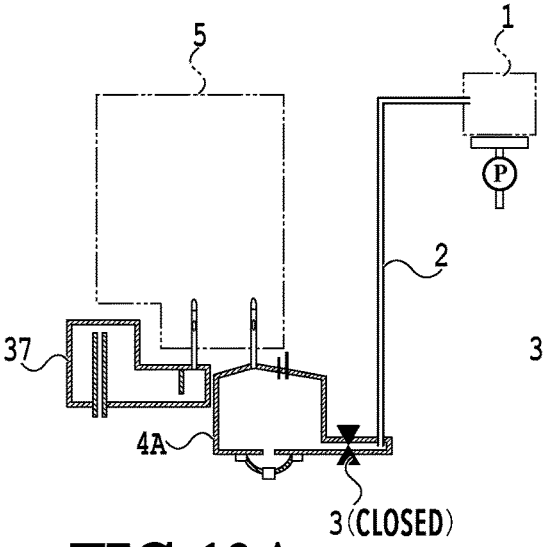
FIGS. 12A to 12E are conceptual diagrams illustrating in stages a filling state of ink in the ink flow channel illustrated in FIG. 10.

FIG. 12A illustrates a state in which the initial installation is started, and in this state, the ink tank 5 and the printing head 1 are not attached to the printing apparatus main body 50*a*. The supply valve 3 is closed.

Figure 12D:
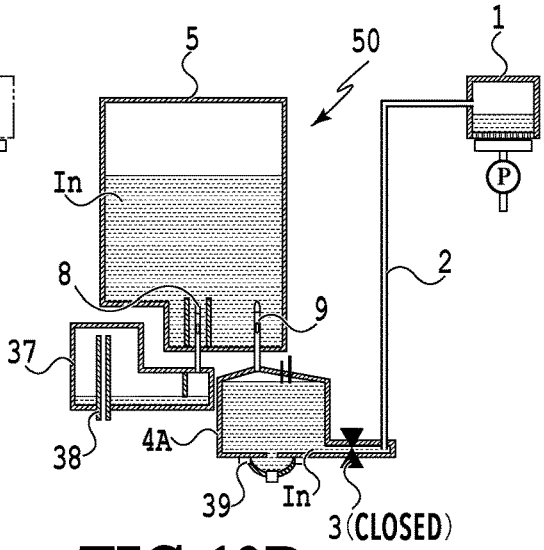
Figure 12B:
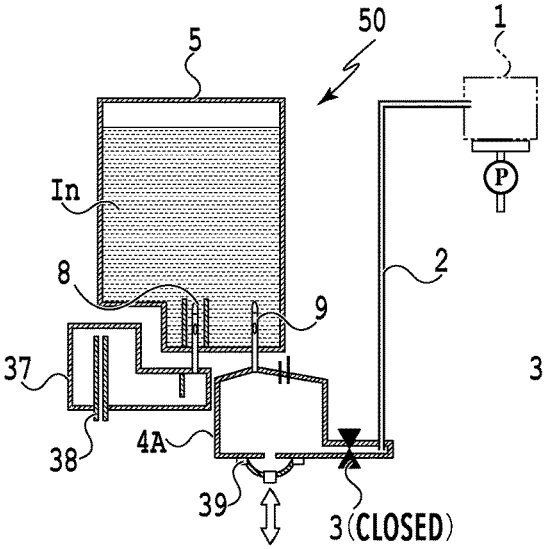
Figure 12E:
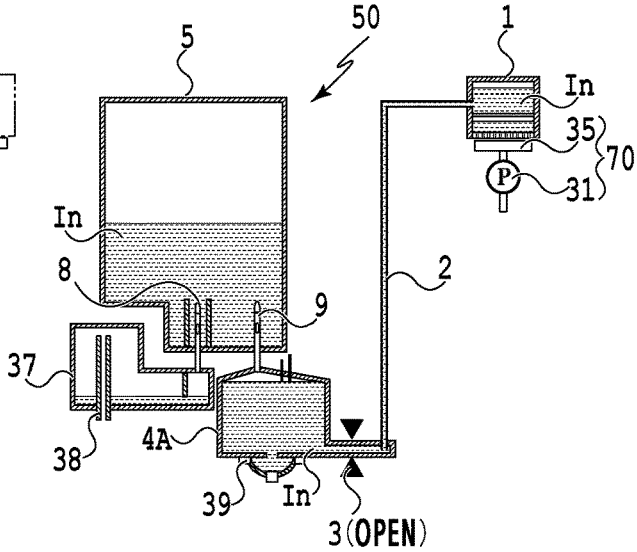

Once the power source of the printing apparatus 50 is activated (ON) (S1101), the operation panel 54 displays the notification prompting the attaching of the ink tank 5 (S1102). In response to the displayed notification, the user attaches the ink tank 5 to the printing apparatus main body 50*a* as illustrated in FIG. 12B. Once the ink tank detection sensor 18 detects the attaching of the ink tank 5 (S1103), the flexible portion 39 is operated to fill the reservoir tank 4A with the ink as illustrated in FIGS. 12B and 12C (S1104).

Specifically, the air in the reservoir tank 4A is pushed (flows) out to the ink tank 5 by decreasing the volume of the flexible portion 39 while the supply valve 3 is closed. Next, the ink In is drawn (flows) from the ink tank 5 to the reservoir tank 4A by increasing the volume of the flexible portion 39. With this operation repeated, the ink In is supplied from the ink tank 5 to the reservoir tank 4A. In this embodiment, the flexible portion 39 and the first hollow tube 8 are also formed such that a relationship of V1>V2 is satisfied, where the amount of variation in the volume of the flexible portion 39 is V1 and the volume in the first hollow tube 8 is V2.

Figure 12C:
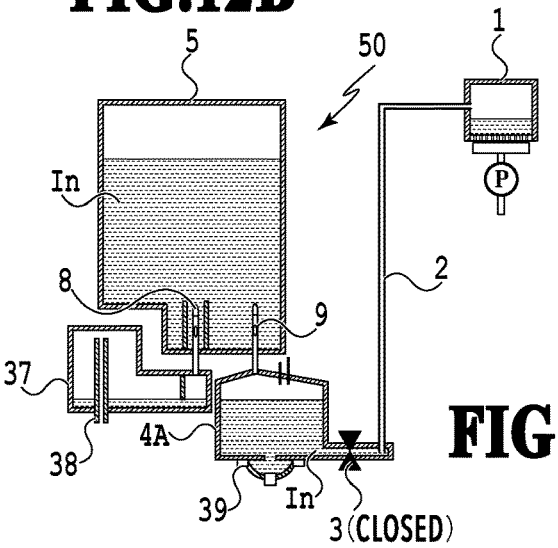

With the volume of the flexible portion 39 continuously varied, the gas-liquid exchange between the ink tank 5 and the reservoir tank 4A progresses, and the liquid level of the ink in the ink tank 5 is decreased while the liquid level of the ink in the reservoir tank 4A is increased as illustrated in FIG. 12C. Then, as illustrated in FIG. 12D, once the liquid surface of the ink in the reservoir tank 4A is brought into contact with the first metal shaft 40 and the second metal shaft 41, it is detected that the reservoir tank 4A is filled up.

In this embodiment, it takes about 2 minutes from the continuous operation of the flexible portion 39 to the moment in which the reservoir tank 4A is filled with the ink. Simultaneously, the operation panel 54 displays the notification prompting the user to attach the printing head 1. Specifically, as illustrated in the flowchart of FIGS. 11A and 11B, once the ink tank detection sensor 18 detects the attaching of the ink tank 5 (S1103), the operation panel 54 displays the notification prompting the attaching of the printing head 1 (S1105). Then, the carriage 60 is moved to the position in which the printing head 1 can be attached (S1106). In this step, the user attaches the printing head 1 in response to the instruction such as "Please attach the printing head" displayed on the operation panel 54.

Thereafter, once the printing head detection sensor 21 detects the attaching of the printing head 1 (S1107), the carriage 60 is moved to the sucking position facing the recovery unit 70 (S1108) to allow the recovery unit 70 to suck out the ink from the printing head 1.

Next, the operation panel 54 displays the notification prompting the attaching of the roll sheet (S1109). Thereafter, it is determined whether the roll sheet is to be attached to the printing apparatus main body 50*a* (S1110). This determination is made based on the setting operation performed by the user, like the processing of S410 in the modification of the above-described first embodiment. If it is determined that the roll sheet is not to be attached, the process proceeds to S1113. If it is determined that the roll sheet is to be attached, the process proceeds to S1111, and it is determined whether the roll sheet detection sensor 22 detects the attaching of the roll sheet. Once the attaching of the roll sheet is detected, a sheet fed out from the roll sheet is subsequently transported to the printing position of the printing apparatus 50 (S1112).

Thereafter, once the first and second metal shafts 40 and 41 detect that the reservoir tank 4A is filled up with the ink (S1113), the operation of the flexible portion 39, which is operated for filling the reservoir tank 4A with the ink from the ink tank 5, is stopped (S1114). Subsequently, with the sucking performed by the suction pump 31, the ink in the supply tube 2 and the reservoir tank 4A is supplied to the printing head 1 to fill the ink supply tube 2 and the printing head 1 with the ink (S1115). If the roll sheet is being attached to the printing apparatus main body 50*a* after the printing head 1 is filled with the ink, the printing head 1 performs the adjustment printing automatically (S1116).

In this embodiment, as illustrated in FIGS. 12B and 12C, if the user detaches the ink tank 5 during the operation of supplying the ink from the ink tank 5 to the reservoir tank 4A, the ink supplying operation is stopped. This is for preventing a splash of the ink from the first hollow tube 8 and contamination of the periphery with the ink. Even if the ink tank 5 is once detached and then attached again, because the supply valve 3 is closed in this embodiment, it is possible to immediately start to supply the ink from the ink tank 5 to the reservoir tank 4A.

As described above, also in this third embodiment, it is possible to reduce the time for the initial installation by attaching the printing head 1 and the roll sheet to the printing apparatus 50 while the ink is being supplied from the ink tank 5 to the reservoir tank 4A.

The above-described third embodiment shows the example of using the flexible portion 33 to supply the ink from the ink tank 5 to the reservoir tank 4A. However, it is also possible to supply the ink from the ink tank 5 to the reservoir tank 4A by using the water head difference.

Figure 13:
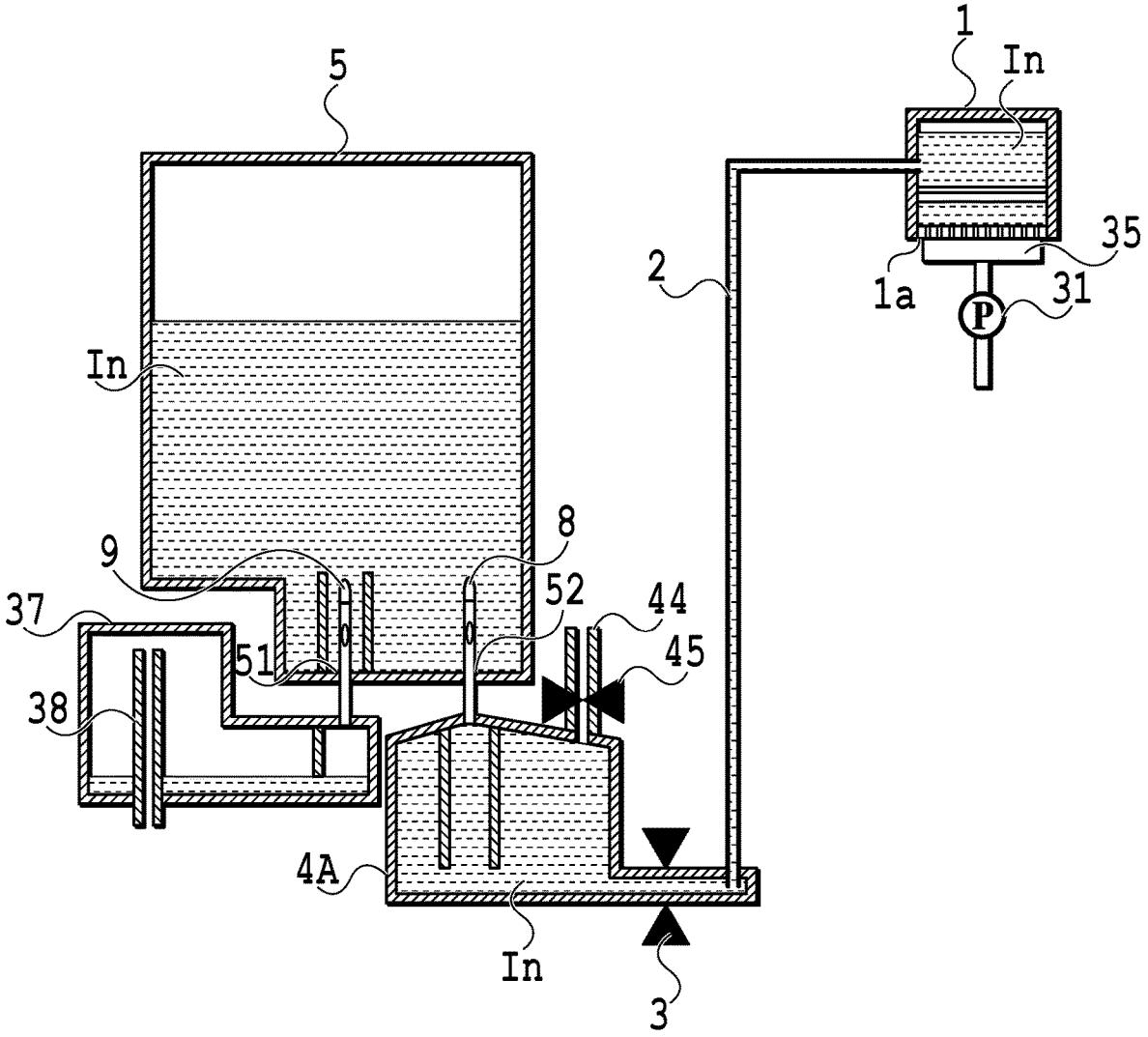
FIG. 13 is a conceptual diagram of an ink flow channel of a modification of the third embodiment.

As an example, a modification of the third embodiment is illustrated in FIG. 13. In this modification, the reservoir tank 4A is provided with an air communication channel 44 and an air valve 45. With the air valve 45 opened, it is possible to supply the ink from the ink tank 5 to the reservoir tank 4A due to the water head difference between the ink tank 5 and the reservoir tank 4A. Even in the case of employing such an ink supply method, it is similar to the third embodiment that it is possible to achieve the reduction of the time for the initial installation by displaying the notification prompting the attaching of the printing head 1 and the roll sheet during the operation of supplying the ink to the reservoir tank.

OTHER EMBODIMENTS

The above-described embodiments show the example in which the electrode 34 or the first and second metal shafts 40 and 41 detect whether the amount of the ink supplied to the reservoir tank 4 reaches a predetermined amount (for example, be filled up). However, the way of detecting the amount of the ink supplied to the reservoir tank is not limited to the above example. For example, the number of times of the operations of the flexible portion 39 may be counted, and once the flexible portion 39 operates a predetermined number of times, the amount of the ink supplied to the reservoir tank 4 may be detected.

Although the example in which the operation panel or the like is used to display the notification prompting the user to attach the ink tank is shown in the above-described embodiments, the notification prompting the attaching of the ink tank may be made by using sounds or using both the sounds and display.

Figure 14:
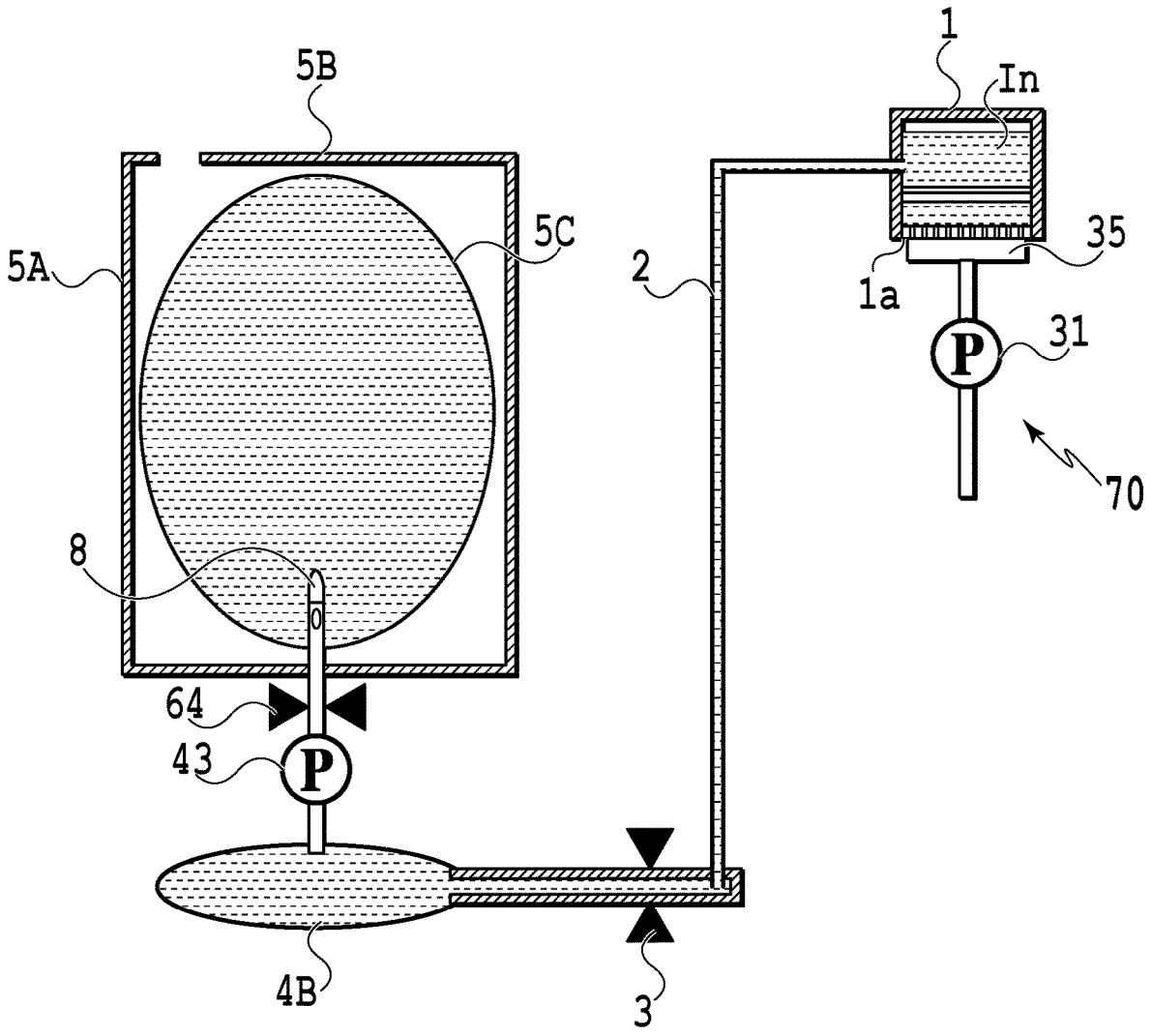
FIG. 14 is a conceptual diagram of an ink flow channel of an ink jet printing apparatus of another embodiment.

The ink tank and the reservoir tank used for the printing apparatus are not limited to a specific shape and configuration. For example, as illustrated in FIG. 14, the present invention may also be applied to a printing apparatus including an ink tank 5A provided with an ink storage unit 5C in the form of a bag and a reservoir tank 4B in which the volume can be varied by a supply pump 43. Specifically, the supply pump 43 starts to supply the ink from the ink storage unit 5C of the ink tank 5A to the reservoir tank 4B, and simultaneously the notifications prompting the attaching of the printing head 1 and the attaching of the roll sheet are made. This allows the user to attach the parts such as the printing head 1 and the roll sheet while the ink is being supplied from the ink tank 5A to the reservoir tank 4B, and it is possible to achieve the reduction of the time for the initial installation. In FIG. 14, a reference numeral 8 indicates a hollow tube that can be inserted to and drawn from the ink storage unit 5C, and a reference numeral 64 indicates a switching valve that switches between the communication and the interruption of the hollow tube 8.

Although the above-described embodiments show the example of the ink jet printing apparatus using the roll sheet as the printing medium to be attached to the printing apparatus main body, the ink jet printing apparatus according to the present invention may be applied to the one using a printing medium other than the roll sheet. For example, the present invention is also applicable to a printing apparatus using cut sheets as the printing medium. In this case, the similar effects as that of the above-described embodiments and modifications can be expected by making a notification prompting attaching of the cut sheets or a cassette storing the cut sheets during the operation of supplying the ink to the reservoir tank.

In the above-described embodiments, a preparation processing other than the attaching of the printing head and the attaching of the roll sheet can be performed as the preparation processing performed during the operation of supplying the ink from the ink tank to the reservoir tank. For example, it is also possible to attach a waste ink tank that is attachable to and detachable from the printing apparatus main body.

Additionally, although the present invention is applied to the serial-type printing apparatus that performs printing while intermittently moving the printing medium in the above-described embodiment, the present invention is also applicable to a so-called full line-type printing apparatus that performs printing while continuously moving the printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-082863 filed Apr. 24, 2019, which is hereby incorporated by reference wherein in its entirety.

What is claimed is:

1. An ink jet printing apparatus, comprising:

an ink tank that is detachably provided to a printing apparatus main body;

a reservoir tank that stores ink supplied from the ink tank;

a printing head that is detachably provided to the printing apparatus main body and ejects the ink supplied from the reservoir tank;

a first supply unit that supplies the ink from the ink tank to the reservoir tank; and a control unit that causes a notification unit to make a notification of a preparation work for a printing operation performed by the printing head while the ink is being supplied by the first supply unit from the ink tank to the reservoir tank.

2. The ink jet printing apparatus according to claim 1, wherein the preparation work is an operation of attaching the printing head to the printing apparatus main body.

3. The ink jet printing apparatus according to claim 1, wherein the preparation work is at least either of an operation of attaching the printing head to the printing apparatus main body and an operation of attaching a printing medium on which printing is performed by the printing head to the printing apparatus main body.

4. The ink jet printing apparatus according to any one of claim 1, wherein the notification unit includes a display unit that displays an instruction to a user.

5. The ink jet printing apparatus according to claim 1, further comprising:

a first detection unit that detects attaching and detaching of the ink tank to and from the printing apparatus main body, wherein in a case where the first detection unit detects that the ink tank is detached from the printing apparatus main body during the operation of supplying the ink from the ink tank to the reservoir tank by the first supply unit, the supplying operation is stopped.

6. The ink jet printing apparatus according to claim 5, further comprising:

a second detection unit that detects attaching and detaching of the printing head to and from the printing apparatus main body, wherein in a case where the first detection unit detects that the ink tank is once detached from the printing apparatus main body and attached thereto again during the supplying operation, the supplying operation is restarted after the second detection unit detects that the printing head is attached to the printing apparatus main body.

7. The ink jet printing apparatus according to claim 1, further comprising:

a second supply unit that supplies the ink from the reservoir tank to the printing head;

an ink detection unit that detects whether an amount of the ink in the reservoir tank reaches a predetermined amount; and a printing head detection unit that detects attaching and detaching of the printing head to and from the printing apparatus main body, wherein in a case where the printing head detection unit detects that the printing head is attached to the printing apparatus main body and the ink detection unit detects that the amount of the ink in the reservoir tank reaches the predetermined amount, the second supply unit starts the supplying of the ink to the printing head.

8. The ink jet printing apparatus according to claim 7, wherein the second supply unit includes a supply valve that switches between communication and interruption between the reservoir tank and the printing head, and in a case where the printing head is to be attached to the printing apparatus main body, the supply valve is controlled to interrupt the communication between the reservoir tank and the printing head.

9. The ink jet printing apparatus according to claim 1, wherein the first supply unit performs the supplying operation from the ink tank to the reservoir tank provided below the ink tank in a direction of gravity by using a water head difference of the ink.

10. The ink jet printing apparatus according to claim 9, wherein the first supply unit includes at least one switching valve that switches supplying and interruption of the ink from the ink tank to the reservoir tank.

11. The ink jet printing apparatus according to claim 1, wherein the first supply unit includes a flexible portion that is provided in the reservoir tank and in which an internal volume can be varied, and a drive mechanism that varies the internal volume of the flexible portion.

12. The ink jet printing apparatus according to claim 10, wherein an ink flow channel connectable to a bottom section of the ink tank is connected to a bottom section of the reservoir tank, and an air introduction channel connectable to the bottom section of the ink tank is connected to a top section of the reservoir tank.

13. The ink jet printing apparatus according to claim 1, further comprising:

an air communication chamber that can be inserted to and drawn from the ink tank.

14. An ink jet printing apparatus, comprising:

an ink tank that is detachably provided to a printing apparatus main body;

a reservoir tank that stores ink supplied from the ink tank;

a printing head that is detachably provided to the printing apparatus main body and ejects the ink supplied from the reservoir tank;

a first supply unit that performs an operation of supplying the ink from the ink tank to the reservoir tank;

a first detection unit that detects attaching and detaching of the ink tank to and from the printing apparatus main body; and a second detection unit that detects attaching and detaching of the printing head to and from the printing apparatus main body, wherein the supplying operation is started after the first detection unit detects the attaching of the ink tank and before the second detection unit detects the attaching of the printing head.

15. A method of controlling an ink jet printing apparatus: the ink jet printing apparatus, comprising:

an ink tank that is detachably provided to a printing apparatus main body;

a reservoir tank that stores ink supplied from the ink tank; and a printing head that is detachably provided to the printing apparatus main body and ejects the ink supplied from the reservoir tank, the method comprising:

making a notification of a preparation work for a printing operation performed by the printing head during an operation of supplying the ink from the ink tank to the reservoir tank.

* * * * *